US005535913A

United States Patent [19]

Asbach et al.

[11] Patent Number: 5,535,913

[45] Date of Patent: Jul. 16, 1996

[54] ODORLESS CONTAINER

[75] Inventors: Ronald M. Asbach, Grand Island; Seth N. Green; James E. Slowe, both of East Aurora, all of N.Y.

[73] Assignee: Fisher-Price, Inc., East Aurora, N.Y.

[21] Appl. No.: 326,284

[22] Filed: Oct. 20, 1994

[51] Int. Cl.[6] ..... B65D 90/04; B65D 43/02; B65D 51/18

[52] U.S. Cl. ..... 220/404; 220/254; 220/502; 220/263; 220/908

[58] Field of Search ..... 220/402, 404, 220/501, 502, 254, 908, 87.1, 263, 602, 288; 383/70; 251/4; 232/44

[56] References Cited

U.S. PATENT DOCUMENTS

| | | | |
|---|---|---|---|
| 1,121,161 | 12/1914 | Bowen . | |
| 1,143,597 | 6/1915 | Clement . | |
| 1,169,606 | 1/1916 | Blank et al. . | |
| 1,194,907 | 8/1916 | Watson . | |
| 1,196,385 | 8/1916 | Mutch . | |
| 1,200,772 | 10/1916 | Stanley . | |
| 1,202,469 | 10/1916 | Anzevino . | |
| 1,208,766 | 12/1916 | Frederick . | |
| 1,226,634 | 5/1917 | Briese . | |
| 1,238,010 | 8/1917 | Fisher . | |
| 1,239,348 | 9/1917 | Bunnell et al. . | |
| 1,239,427 | 9/1917 | Bunnell et al. . | |
| 1,265,148 | 5/1918 | Warren . | |
| 1,272,443 | 7/1918 | Himmelberger . | |
| 1,286,368 | 12/1918 | Lucas . | |
| 1,670,668 | 5/1928 | Oishei | 220/288 |
| 1,690,892 | 11/1928 | Diament | 220/602 |
| 1,907,082 | 5/1933 | Meltzer . | |
| 1,936,262 | 11/1933 | Poet | 220/86 |
| 2,411,430 | 11/1946 | Hodson | 220/17 |
| 2,946,474 | 7/1960 | Knapp | 220/17 |
| 3,158,874 | 12/1964 | Bennett | 4/484 |
| 3,401,409 | 9/1968 | Ekrut | 4/484 |
| 3,836,037 | 9/1974 | Bass | 220/35 |
| 3,943,578 | 3/1976 | Miya et al. | 4/484 X |
| 4,376,491 | 3/1983 | Banker, Jr. | 383/70 |
| 4,427,110 | 1/1984 | Shaw, Jr. | 206/205 |
| 4,580,688 | 4/1986 | Harris et al. | 220/1 T |
| 4,869,049 | 9/1989 | Richards et al. | 53/459 |
| 4,934,529 | 6/1990 | Richards et al. | 206/303 |
| 4,953,732 | 9/1990 | Cocks | 220/502 |
| 5,022,553 | 6/1991 | Pontius | 220/410 |
| 5,056,293 | 10/1991 | Richards et al. | 53/116 |
| 5,125,526 | 6/1992 | Sumanis | 220/263 |
| 5,147,055 | 9/1992 | Samson et al. | 220/254 |
| 5,158,199 | 10/1992 | Pontius | 220/410 |
| 5,174,462 | 12/1992 | Hames | 220/87.1 |
| 5,211,370 | 5/1993 | Powers | 251/4 |
| 5,269,434 | 12/1993 | Labuda | 220/908 X |
| 5,385,259 | 1/1995 | Bernstein et al. | 220/908 X |
| 5,464,189 | 11/1995 | Li | 251/4 |

OTHER PUBLICATIONS

"Turn 'N Seal Diaper Pail"(Product No. 168–The Odor Free Diaper Disposal System), 1994 product catalogue, p. 21.

*Primary Examiner*—Allan N. Shoap
*Assistant Examiner*—Nathan J. Newhouse
*Attorney, Agent, or Firm*—Howrey & Simon; C. Scott Talbot; Melvin L. Barnes, Jr.

[57] ABSTRACT

An odorless container having a selectively openable flexible sleeve that creates a seal between a holding chamber where waste is deposited and a storage chamber where waste is stored so that odors from the storage chamber do not escape when waste is deposited into the holding chamber. Operation of the pail involves opening the lid, depositing the waste into the holding chamber, and closing the lid. The flexible sleeve is then opened allowing the waste to fall from the holding chamber into the storage chamber. Finally, the flexible sleeve is closed to prepare the pail for the next deposit of waste. Therefore, odors from the second chamber are never directly exposed to the outside environment.

33 Claims, 21 Drawing Sheets

ODORLESS CONTAINER

BACKGROUND OF THE INVENTION

The invention relates generally to waste disposal, and in particular to a receptacle for temporarily storing odoriferous waste and containing objectionable odors. Children's diapers are a common odoriferous waste material that require temporary storage in the home until they are washed (if reusable) or disposed of (if disposable).

A conventional waste container typically consists of a pail open at one end that serves as a storage chamber and a removable lid to cover the pail's open end. To use such a container, the user removes the lid, deposits the waste in the pail, and replaces the lid. Offensive fumes and odors emanating from the waste material contained in the closed pail accumulate in the pail and assault the user's senses when the lid is next removed. Consequently, routine use of such a conventional garbage pail repeatedly exposes the user, and those nearby, to the offensive odors accumulated in the pail from the previously deposited waste. Furthermore, many such garbage containers do not have an air tight seal between the pail and lid, permitting odors to escape even when the lid is in place.

Several approaches have been taken in designing garbage receptacles that attempt to insulate the user from exposure to the offensive odors accumulated in the receptacle. These approaches can be classified as odor absorbers, inner lids or seals, air locks, and individual packaging.

The odor absorber approach relies on mechanical or chemical absorption or adsorption of accumulated odors. A suitable absorber is disclosed in U.S. Pat. No. 5,174,462 to Hames, incorporated by reference, which uses an actuated charcoal adsorber mounted in a perforated holder beneath the container lid. Although such absorbers can reduce the amount of objectionable odors, they cannot eliminate them, and they require periodic replacement.

Several devices have been proposed that add an inner lid or seal between the conventional container's pail and outer lid to reduce leakage of odors when the outer lid is closed and/or to minimize the time during which the user is exposed to the odors accumulated in the pail while adding more waste. One example of such a device is described in U.S. Pat. No. 4,427,110 to Shaw, Jr. This device includes a canister and seal insert having a plurality of slits intersecting centrically to provide flexible sliced pre-shaped sectors adapted to be flexed downward into the canister base. A top has a frusto-conical plunger adapted to flex the sectors of the insert downward to allow a diaper deposited on the insert to fall into the canister. The top also has a handle with a deodorizer.

The Turn'N Seal Diaper Pail, sold by Safety 1st, also incorporates such an inner lid. This pail also has a mechanism for twisting closed the neck of a plastic liner bag, by rotating the lid while closed, to avoid exposing the user to the contents of the storage chamber when the bag is full and must be sealed and removed.

The resealable opening approach is exemplified by U.S. Pat. No. 5,125,526 to Sumanis, which discloses a garbage pail in which a bag is secured to a rotatably mounted holder inside the pail. The top of the bag is fastened in place so that rotation of the holder opens and closes the neck of the bag (by twisting it). When a footpedal is depressed, a linkage opens the lid and rotates the holder to open the bag. Releasing the footpedal closes the lid and rotates the holder to dose the bag. This device suffers from the same drawback as of conventional containers of exposing the user to the accumulated odors when the lid is open, since the bag is open simultaneously.

In the air lock approach, the container includes a lid that covers a first chamber, a transfer mechanism, and a second chamber for finally receiving the waste. The user opens the lid, deposits the waste into the first chamber, and closes the lid. The user then actuates the transfer mechanism to transfer the waste material from the first chamber into a second chamber. Examples of this approach are disclosed in U.S. Pat. Nos. 1,226,634 to Briese; 1,239,427 to Bunnel & Gates; and 1,265,148 to Warren.

The individual packaging approach is shown in U.S. Pat. No. 4,869,049 to Richards et al., in which a container has an inner storage chamber accessed via a closable lid and an intermediate tubular core. A length of flexible tubing is stored along side the core with a closed end disposed at the lower end of the core. After a diaper is deposited into the tube, the core is rotated, which twists the flexible tube to create a seal above the diaper. To dispose of the next diaper, the user opens the lid and inserts the diaper. Pushing the previous seal downward (which pushes the previous diaper into the storage chamber) then creates a new seal by twisting the tube above the newly deposited diaper. Consequently, the device stores the diapers in a series of individually wrapped packages in the storage chamber—each package being separated from adjacent packages by twists in the tube. Although this system prevents the escape of offensive odors, it requires the use of special tubing and the user to manually prepare the tube for each succeeding diaper that is deposited.

SUMMARY OF THE INVENTION

The drawbacks of the prior art are overcome by the present invention, which provides an odorless container for receiving waste material having a holding chamber and a storage chamber separated by a selectively openable flexible sleeve that prevents odors from escaping from the storage chamber when waste is deposited into the holding chamber. The odorless container includes a pail having an open end, a fixed main cover mounted on the open end of the pail, a twist ring rotatably mounted to the under side of the main cover, a bag retainer mounted on the main cover, and a lid pivotally attached to the main cover. The twist ring, main cover, and bag retainer have concentric openings that form a passage for the deposit of waste. A flexible sleeve, which is essentially an open ended tube, has a first end attached to the lower end of the twist ring and a second end attached to the bottom end of the main cover. A liner, such as a plastic bag, is placed inside the pail with its open end passing through the passage formed by the openings of the rings and attached to the bag retainer and thus fixed in place. By rotating the twist ring, the flexible sleeve closes in a manner similar to the aperture of a camera to pinch the neck of the plastic bag closed and thus to seal the storage chamber from the outside environment.

Operation of the container involves opening the lid, depositing the waste into the holding chamber, and closing the lid. The flexible sleeve is then opened allowing the waste to fall from the holding chamber into the storage chamber. Finally, the flexible sleeve is closed to prepare the pail for the next deposit of waste. Therefore, odors from the storage chamber are never directly exposed to the outside environment.

DETAILED DESCRIPTION

Figure 1A:
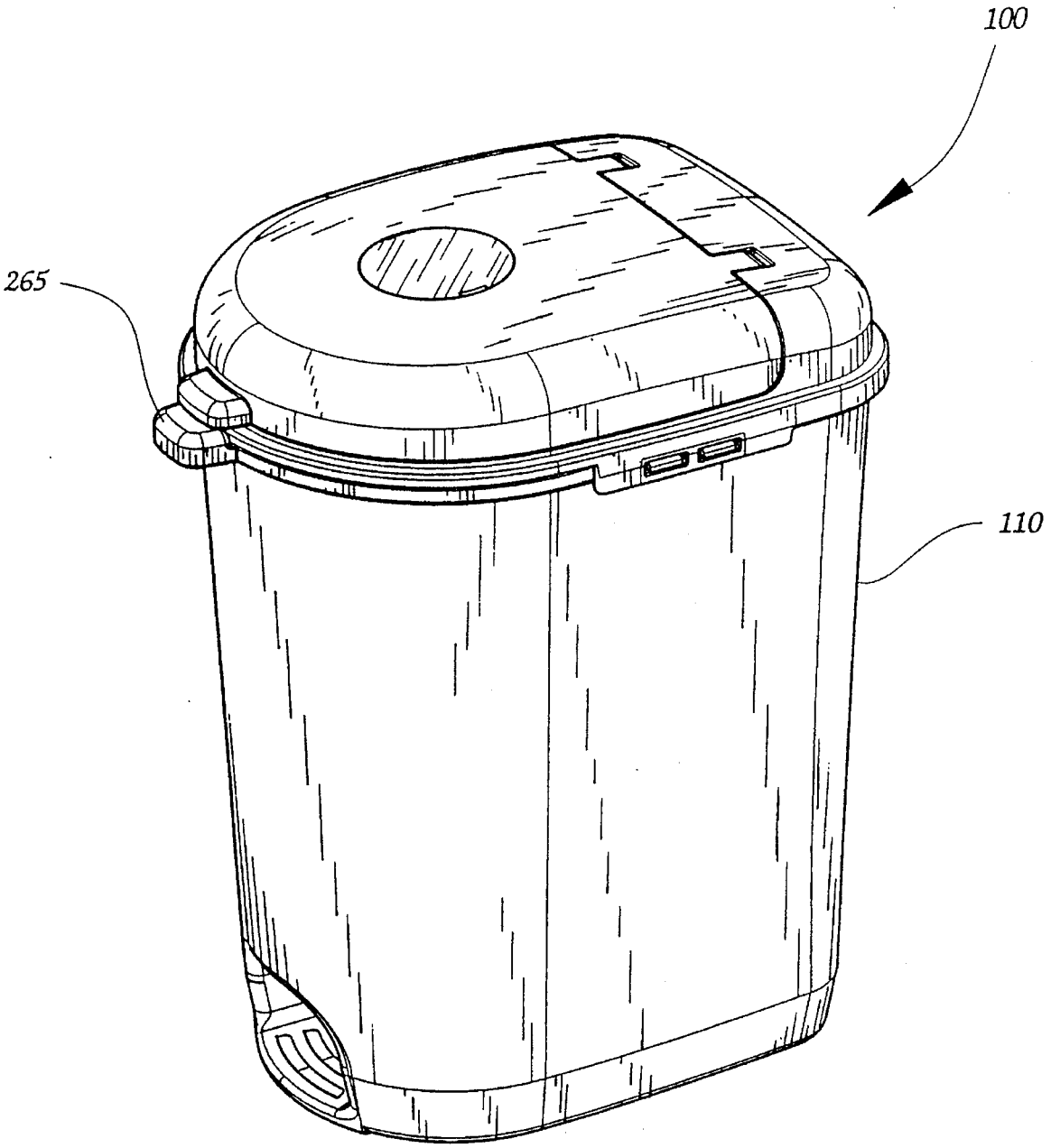
FIGS. 1A–D are front and rear perspective views, rear elevation, and top plan views of an odorless container employing the principles of the present invention
Figure 1B:
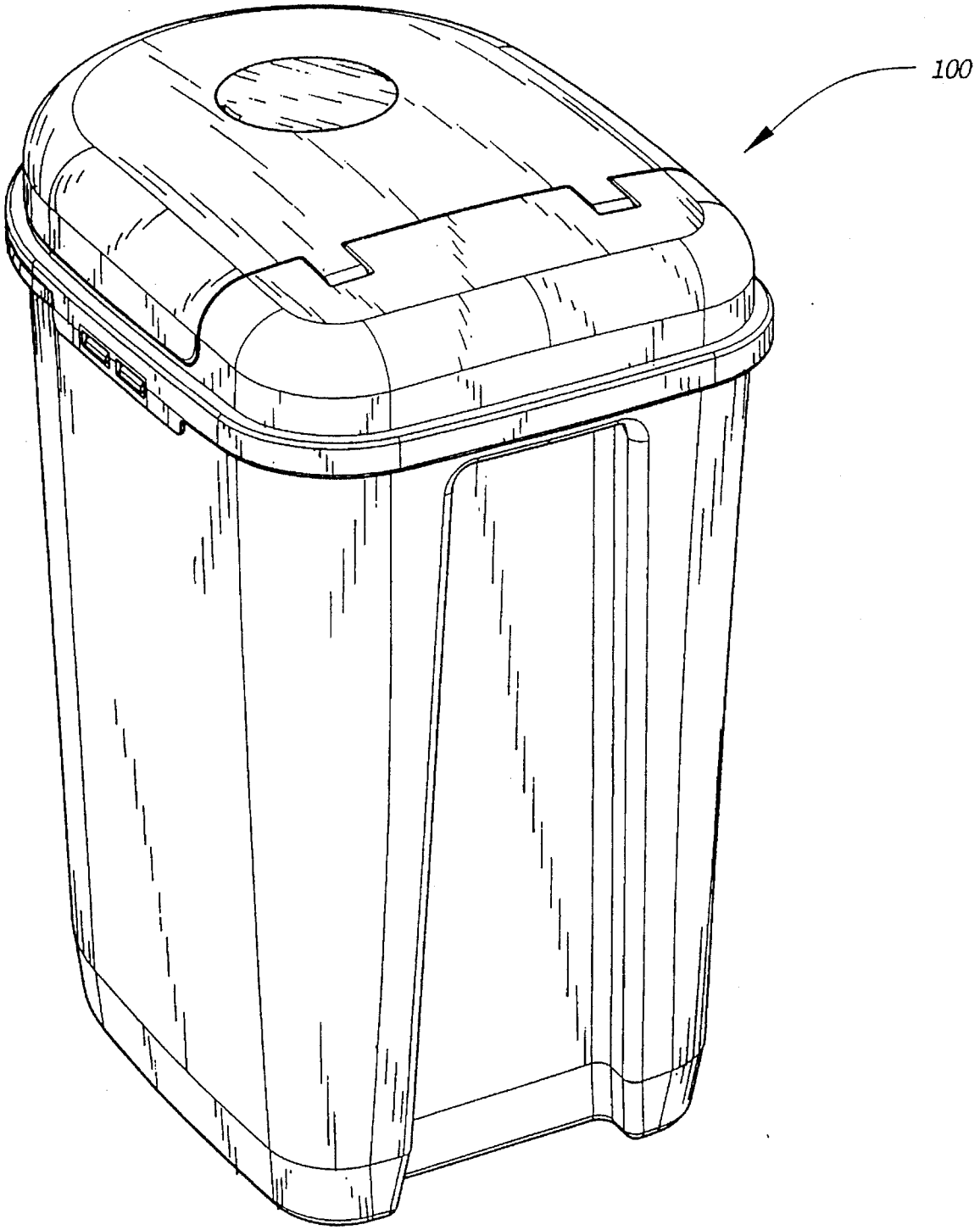
Figure 1C:
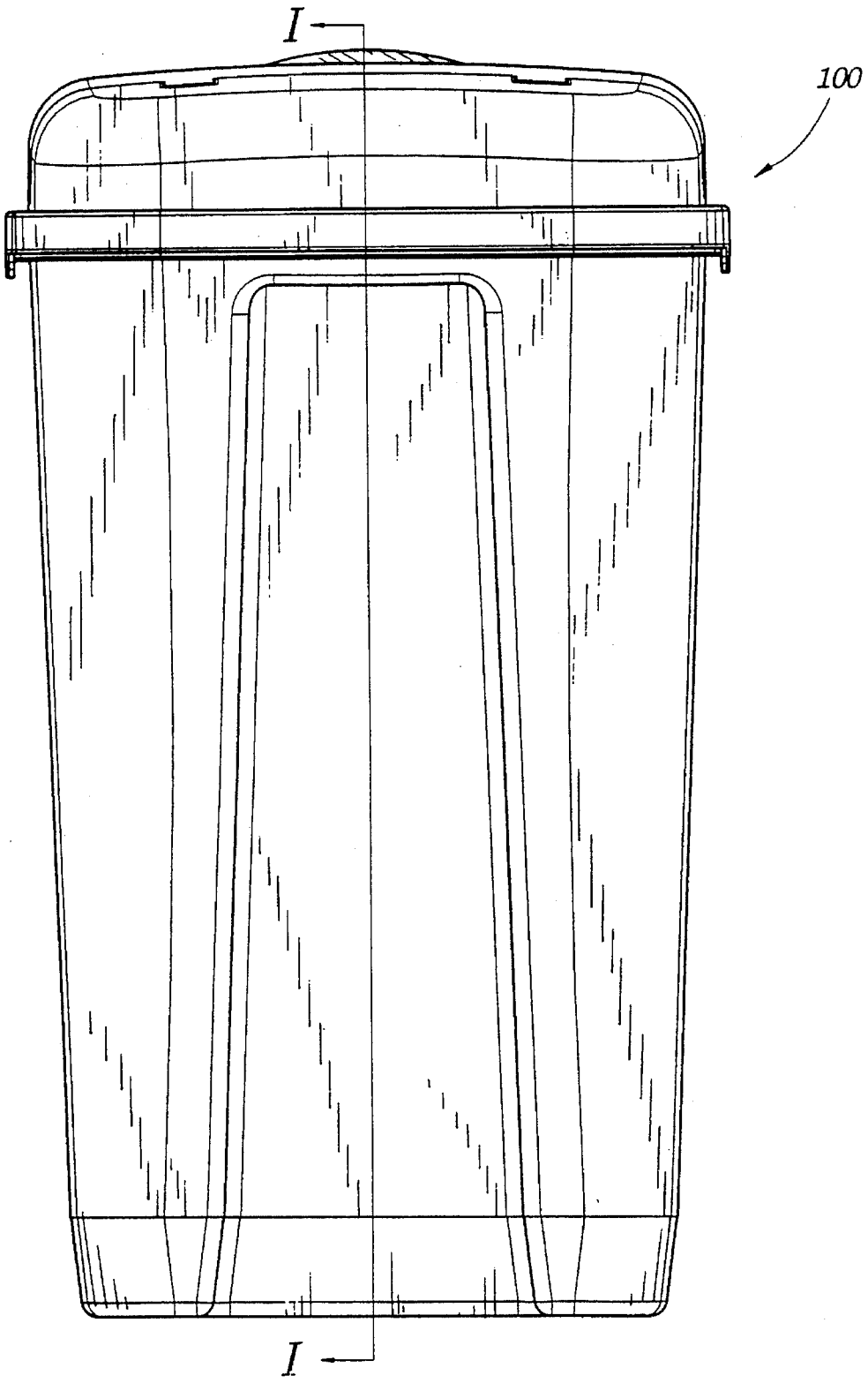

The invention is described and illustrated below in the context of a diaper disposal pail. However, the dimensions and design of the odorless container may be modified to accommodate any waste material having unpleasant or hazardous odors, fumes, hazardous bacteria, or other airborne matter. Other such applications of this invention would include use in a trash can, a medical waste receptacle, and a chemical waste receptacle.

As shown in FIGS. 1A–E and 2, odorless container 100 includes a pail 110, a main cover 200 seated on the open end 122 of pail 110, a lid assembly 130 hinged to main cover 200, a bag retainer 150, a twist ring 250 nested under main cover 200, and a flexible sleeve 300 (shown in FIG. 9A) attached to twist ring 250 and main cover 200.

Pail 110, which is shown in FIGS. 3A–D, has a generally flat bottom wall 120 and upward depending generally planar rear, left, and right side walls 112, 114, 116 respectively, and semi-cylindrical front wall 118. The bottom and upstanding walls define a storage chamber 600 with an open end 122. The upper ends of the upstanding walls terminate in a flat beaded rim 123, with the upper end of front wall 118 forming a semicircular front portion 124 of rim 123, which is separated from left side portion 127 and right side portion 128 of rim 123 by left and right flange grooves 125 and 126 while rear portion 129 of rim 123 extends across rear wall 112. A foot recess 111, is formed at the bottom end of front wall 118, and a hand grip recess 113 is formed at the upper end of rear wall 112. Left and right engagement tabs 115, 119 extend outward from the upper portions of left and right side walls 114, 116, respectively.

As shown in FIGS. 4A–D, main cover 200 has a generally annular body portion 205, with a stepped cylindrical tube 206 depending downwardly from its inner periphery, and a stepped cover rim 207 depending downwardly from its outer periphery. Body portion 205 also includes an upper lid hinge portion 210 and a lid shoulder 211 extending about the cover body from lid hinge portion 210. Lid hinge portion 210 includes left and right ring lid hinge recesses 212 and 213. Stepped cylindrical tube 206 defines a cover waste passage 215, and has an upper portion 216 terminating at its lower end in an upper radially-inwardly projecting annular retainer ring support shoulder 217. A twist ring support portion 220 depends downwardly from the inner periphery of upper shoulder 217, and includes several beveled rim support tabs 221 projecting outwardly from its outer surface and a lower shoulder 225 projecting radially inwardly from its lower end. Finally, inner sleeve support portion 230 depends downwardly from the inner periphery of lower shoulder 225, and includes several inner sleeve support posts 235 projecting radially outwardly from its outer surface.

Stepped cover rim 207 includes a front portion 240 and a rear portion 241 corresponding generally to front and rear portions 124, 129, of beaded pail rim 123. Support ribs 242 extend downward from under the sides and rear portion 241 of stepped cover rim 207 to rest on pail rim 123. Left cover bracket 244 and right cover bracket (not shown) depend downwardly from stepped rim cover 207 so that left bracket apertures 295 receive left engagement tabs 115 of pail 110 and right bracket apertures (not shown) receive right engagement tabs 119 of pail 110 to retain main cover 200 on pail 110. Cover rim front portion 240 is spaced from pail rim front portion 124 to accommodate twist ring 250 therebetween. Cover rim front portion 240 also includes a lid latch 246 with aperture 247 and latch finger 248.

Figure 5A:
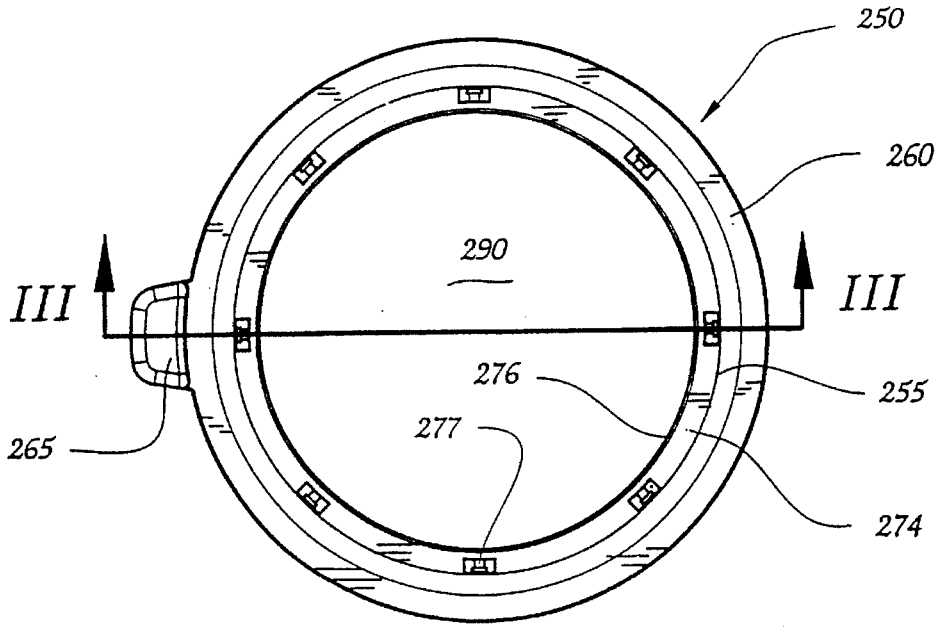
FIGS. 5A and B are top and front views of the twist ring of the odorless container of FIG. 1
Figure 5B:
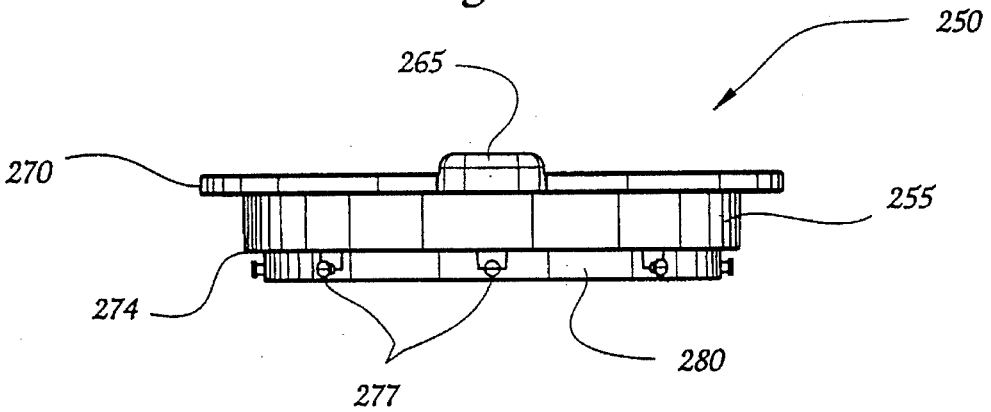
FIG. 5C is a cross-sectional view taken along line III—III in FIG. 5A.
Figure 5C:
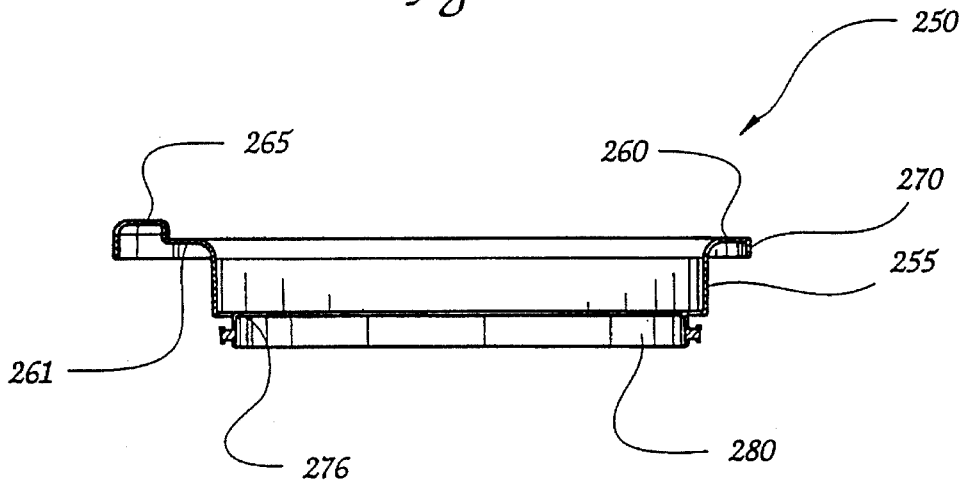

Twist ring 250, shown in FIGS. 5A–C, has a generally cylindrical body portion 255 with a generally horizontal upper rim 260 extending radially outwardly from the upper end of body portion 255 and including a downwardly depending flange 270 extending around nearly the entire perimeter of rim 260 except for the portion of rim 260 from which handle 265 extends. Body portion 255 terminates in radially inwardly projecting shoulder 274. Sleeve retaining rim 280 depends downwardly from the inner perimeter of shoulder 274 and includes outwardly projecting posts 277 equally spaced around the perimeter. Inwardly projecting support lip 276 extends inward from the junction of shoulder 274 and rim 280. Sleeve retaining rim 280 and cylindrical body portion 255 define a waste passage 290, therethrough.

Figure 1D:
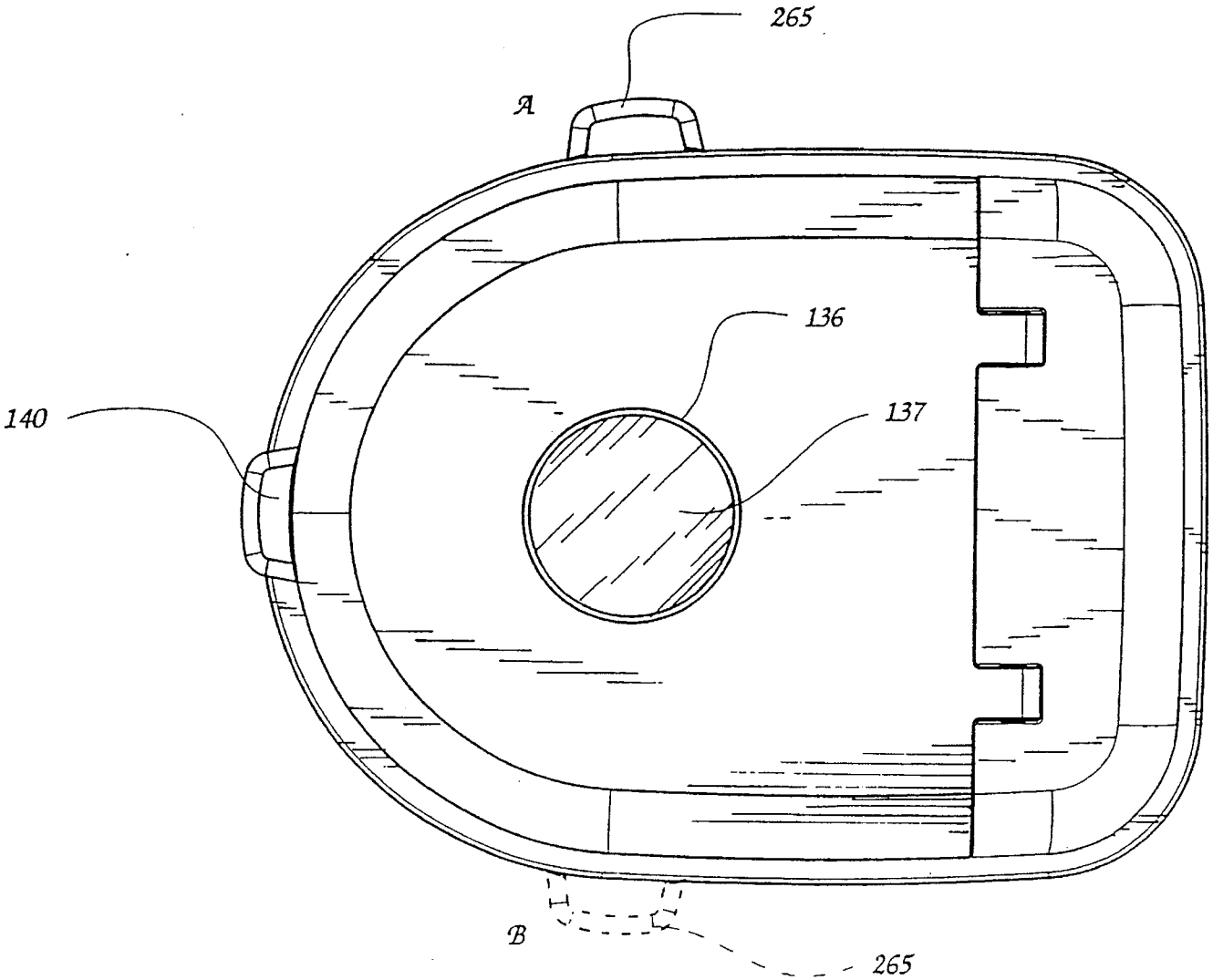
Figure 1E:
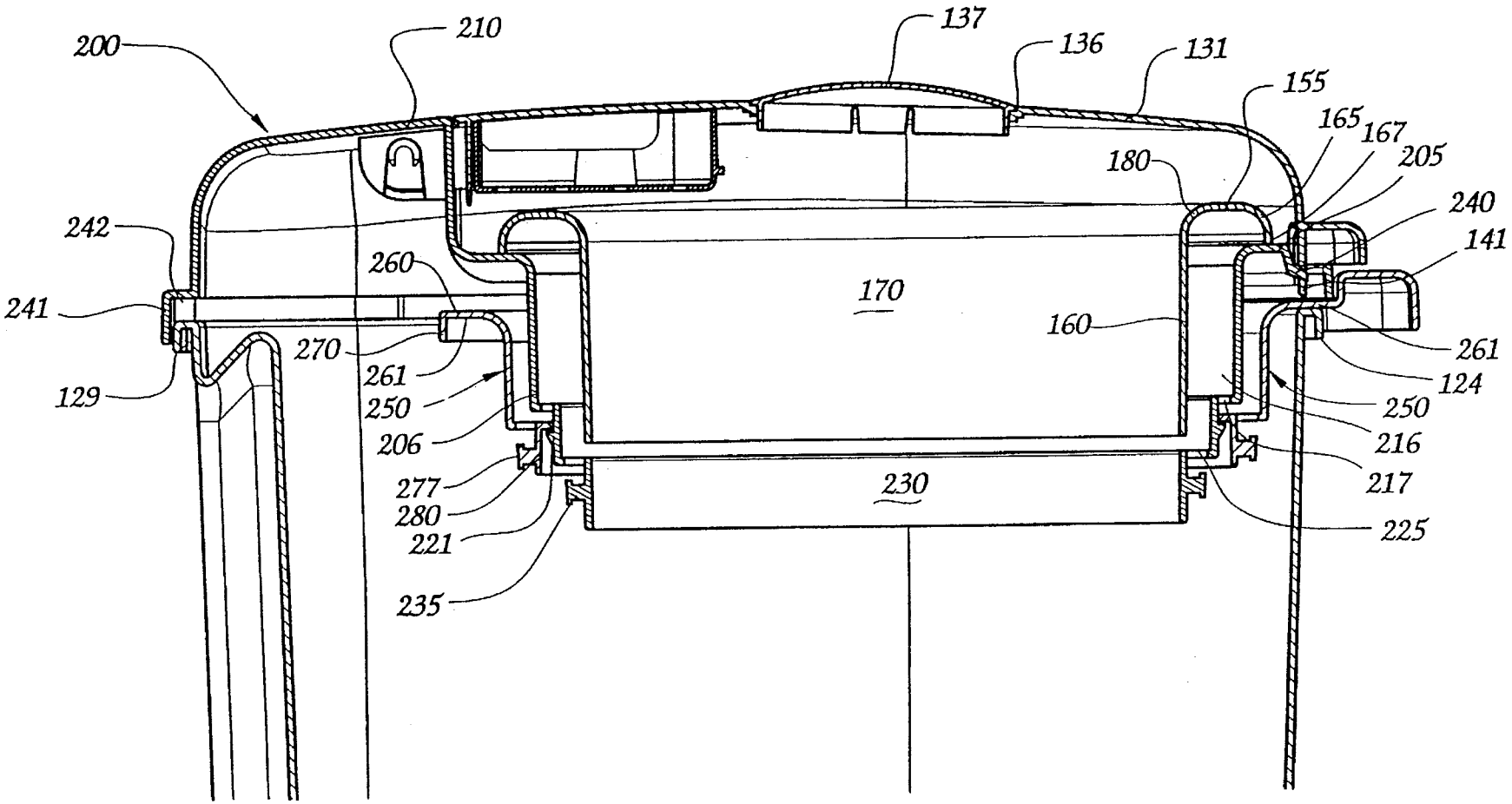
FIG. 1E is a partial cross-sectional view of the odorless container taken along line I—I in FIG. 1C.
Figure 2:
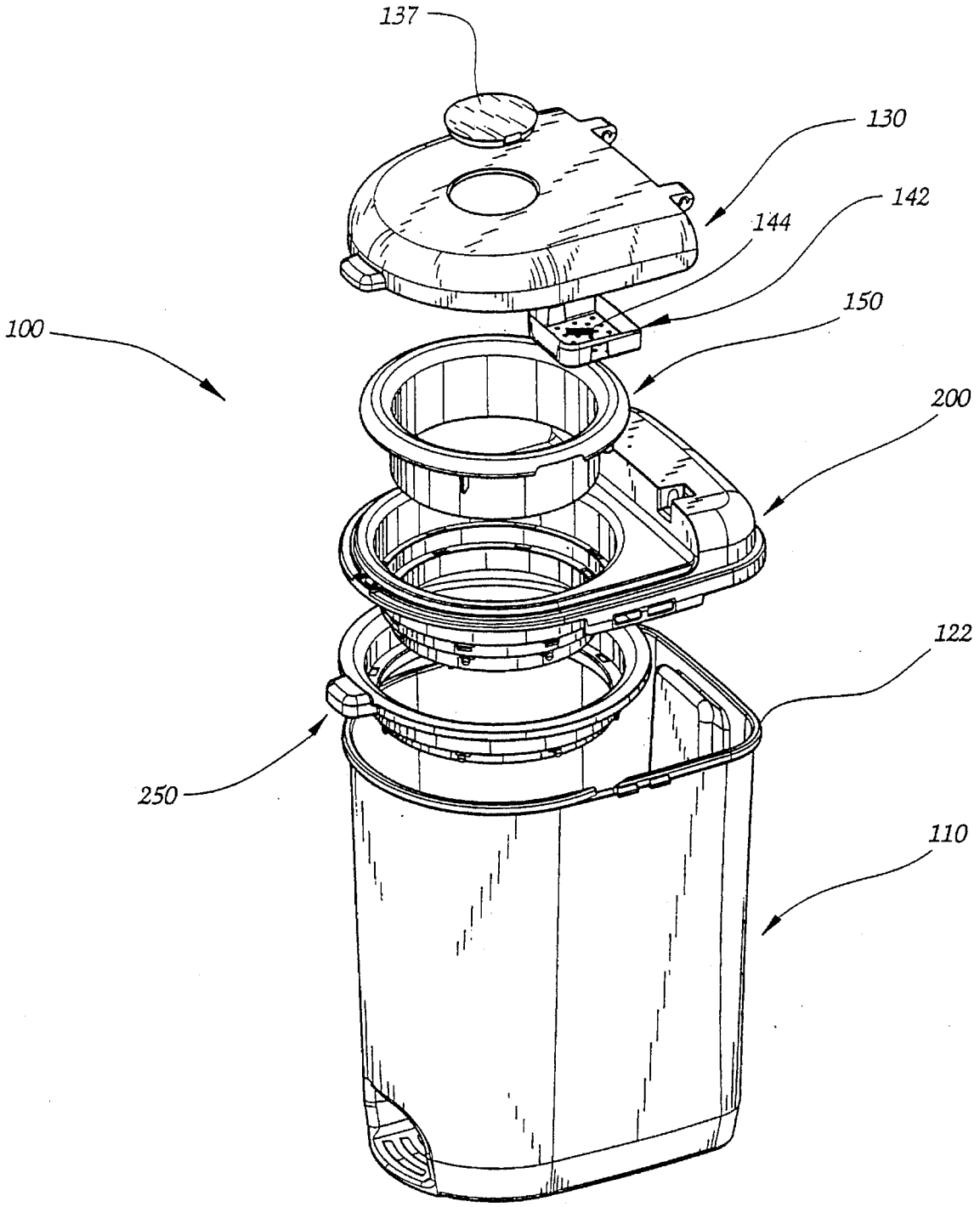
FIG. 2 is an exploded perspective view of the odorless container of FIG. 1.
Figure 3A:
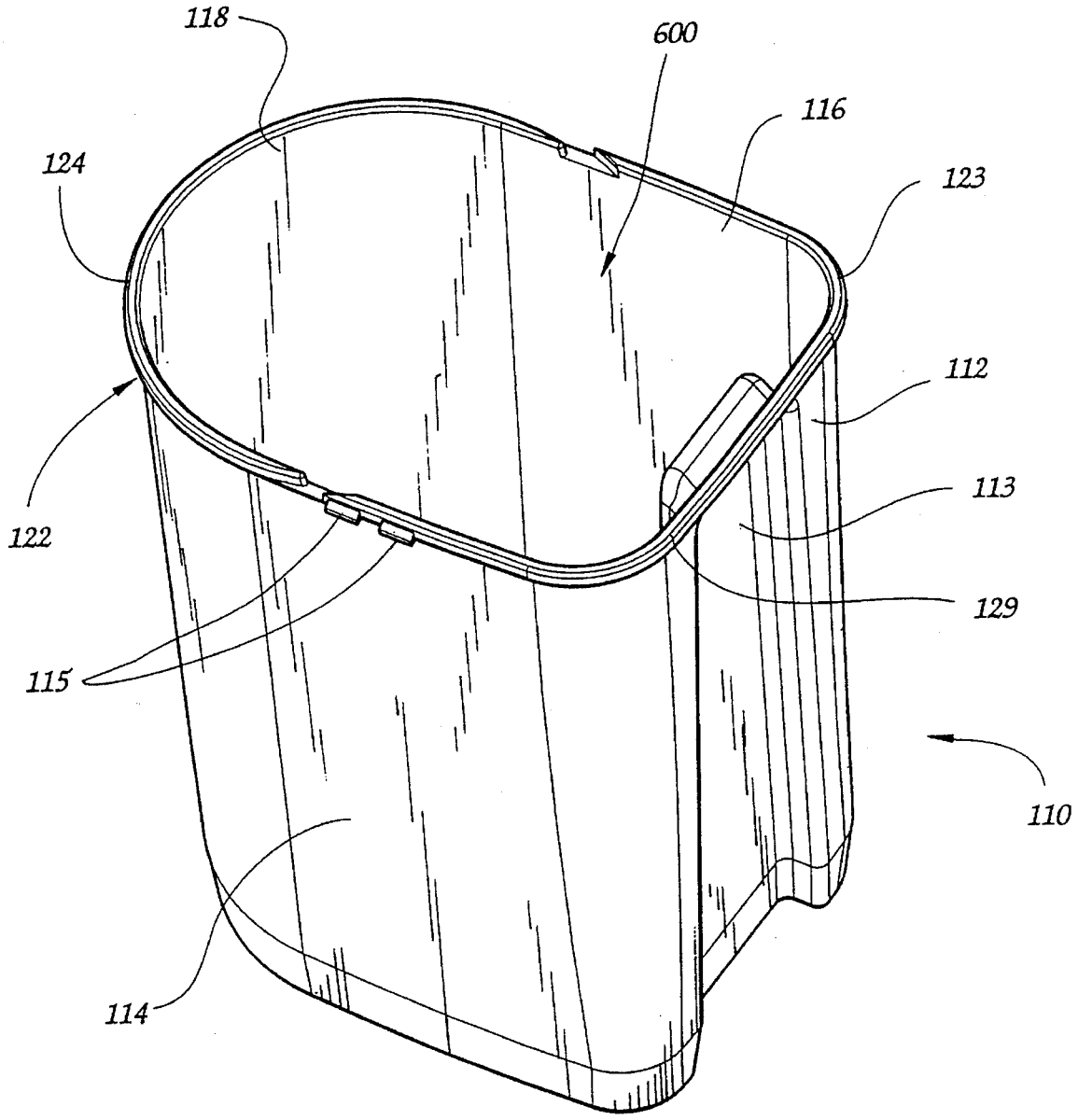
FIGS. 3A–C are perspective, top and bottom views of the pail of the odorless container of FIG. 1
Figure 3B:
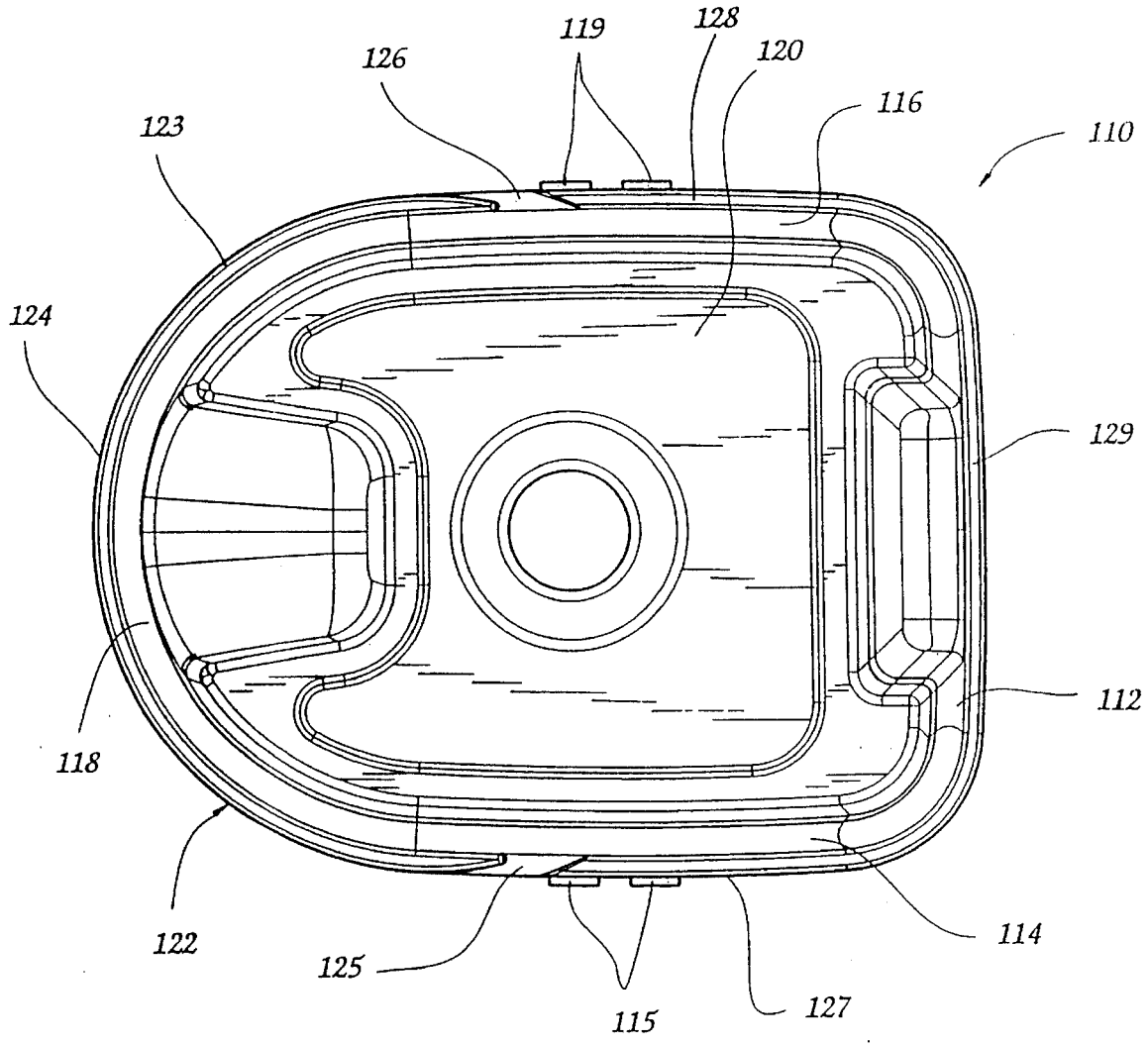
Figure 3C:
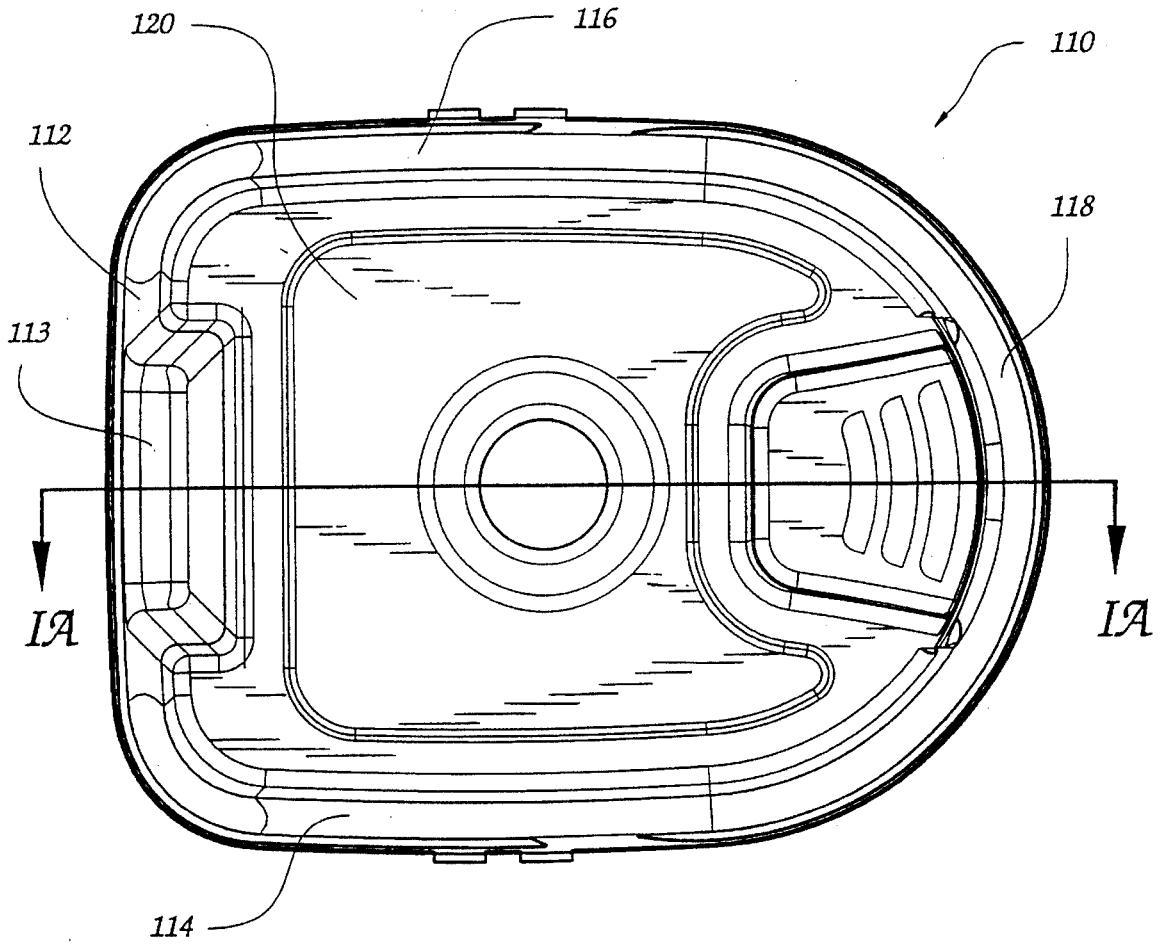
Figure 3D:
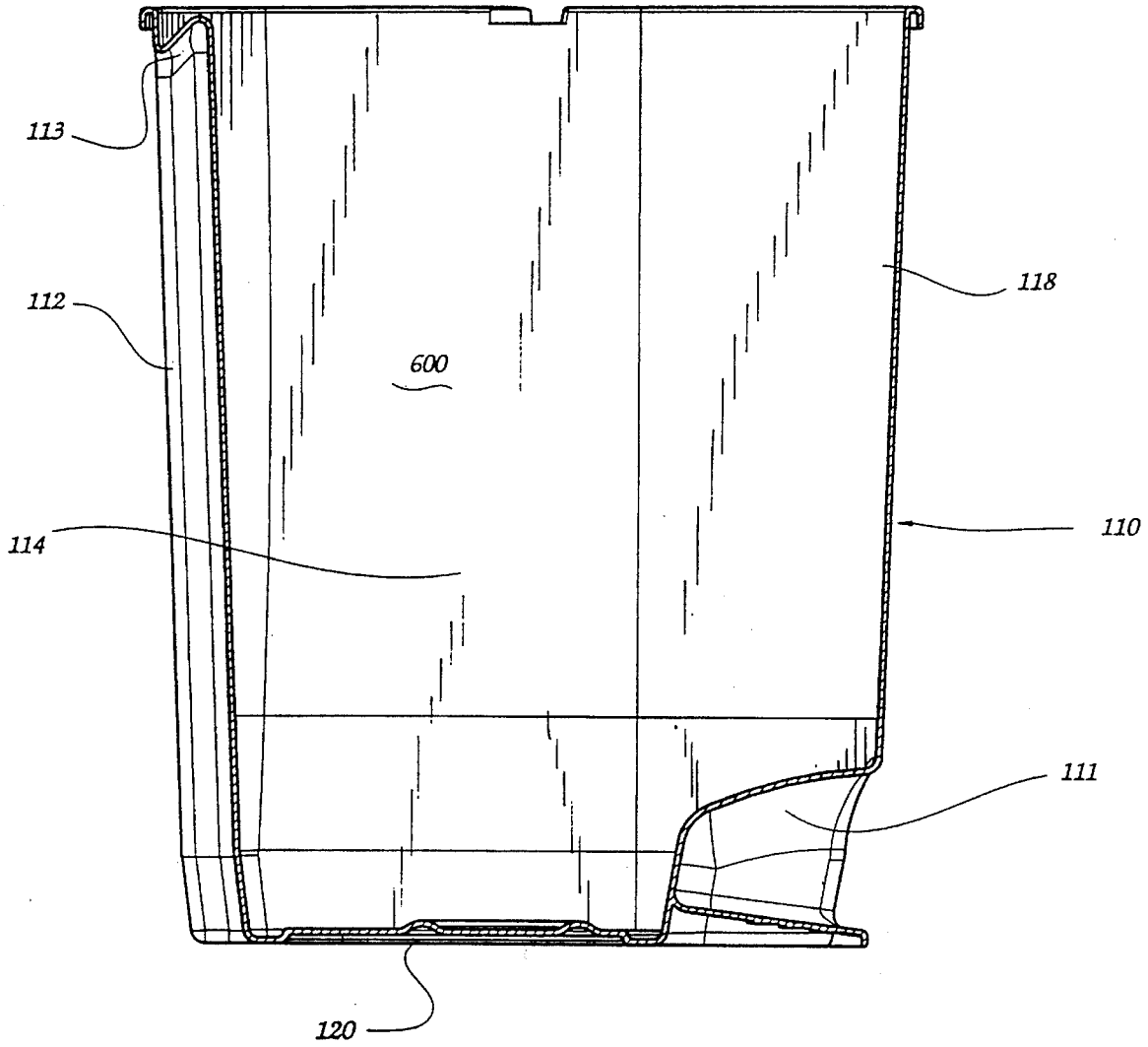
FIG. 3D is cross-sectional view of the pail taken along line IA—IA in FIG. 3C.
Figure 4A:
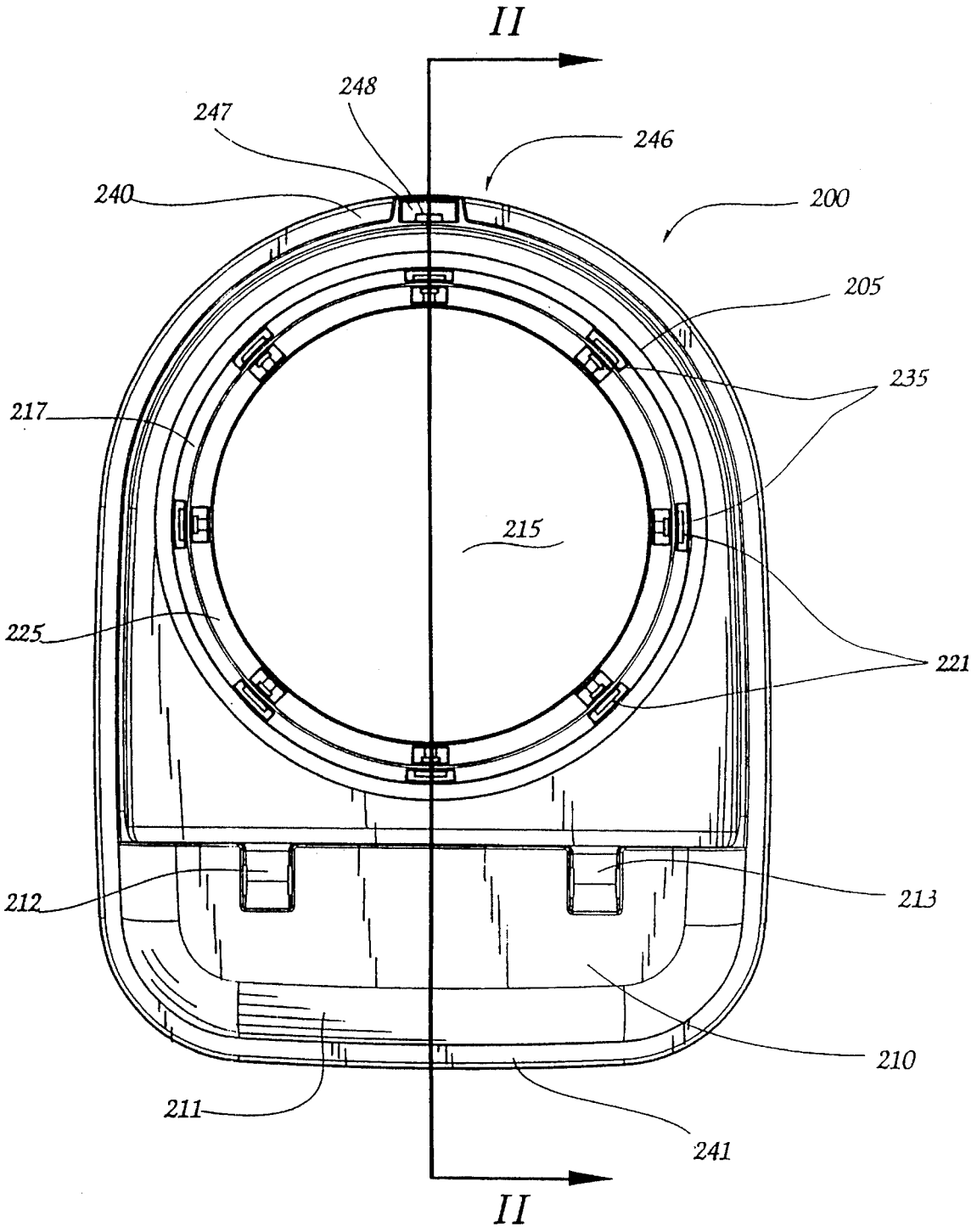
FIGS. 4A–C are top and bottom plan, and side elevation views, respectively, the main cover of the odorless container of FIG. 1.
Figure 4B:
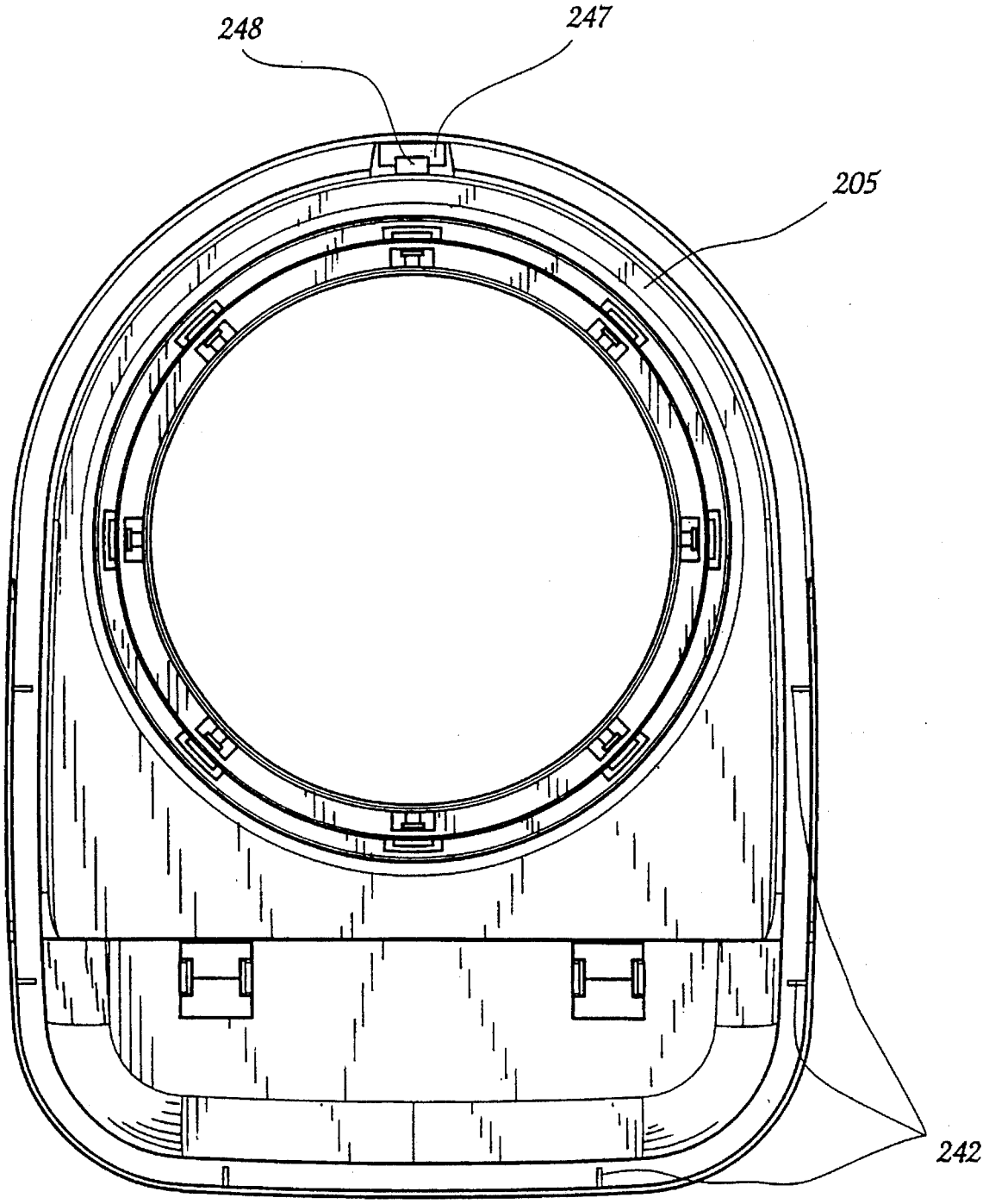
Figure 4C:
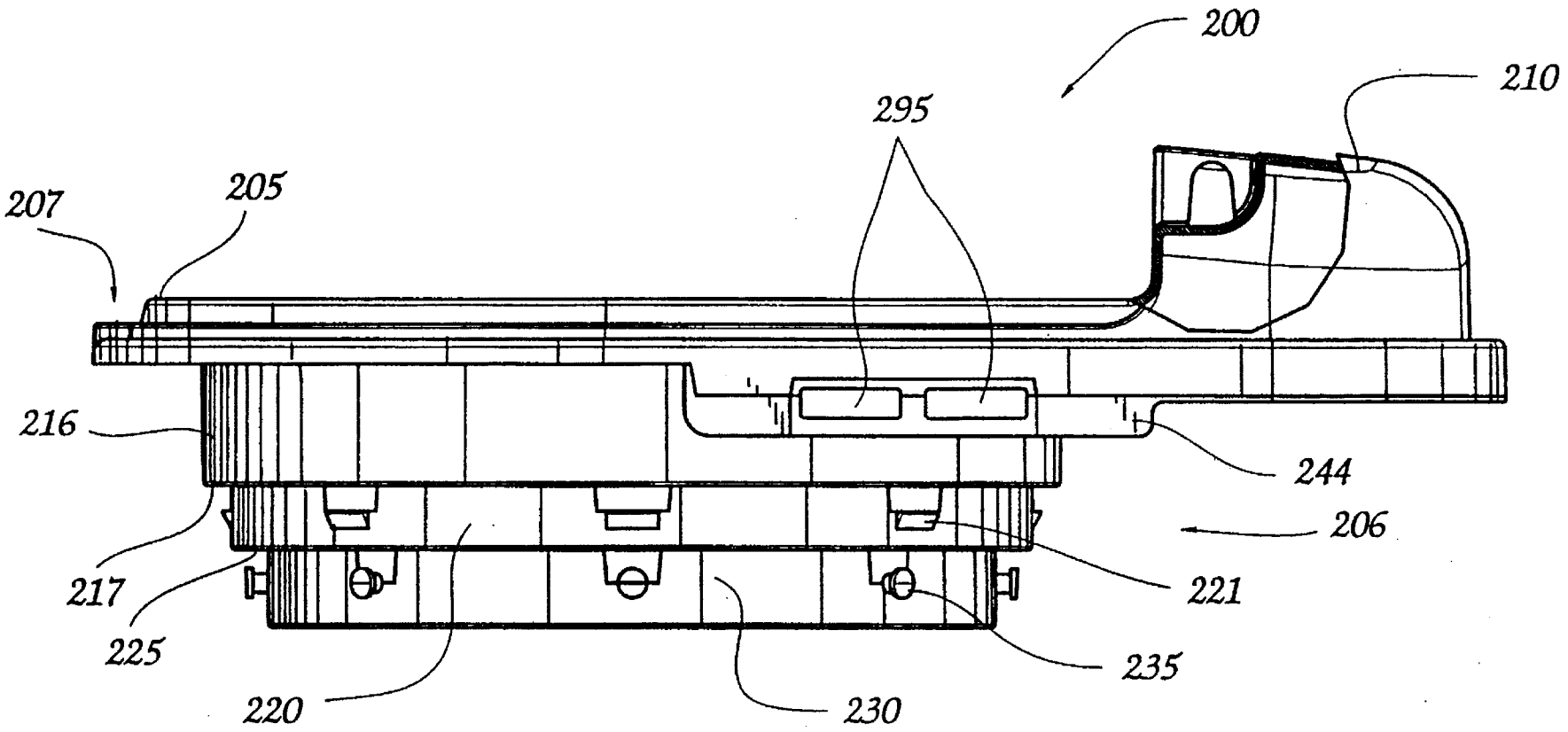
Figure 4D:
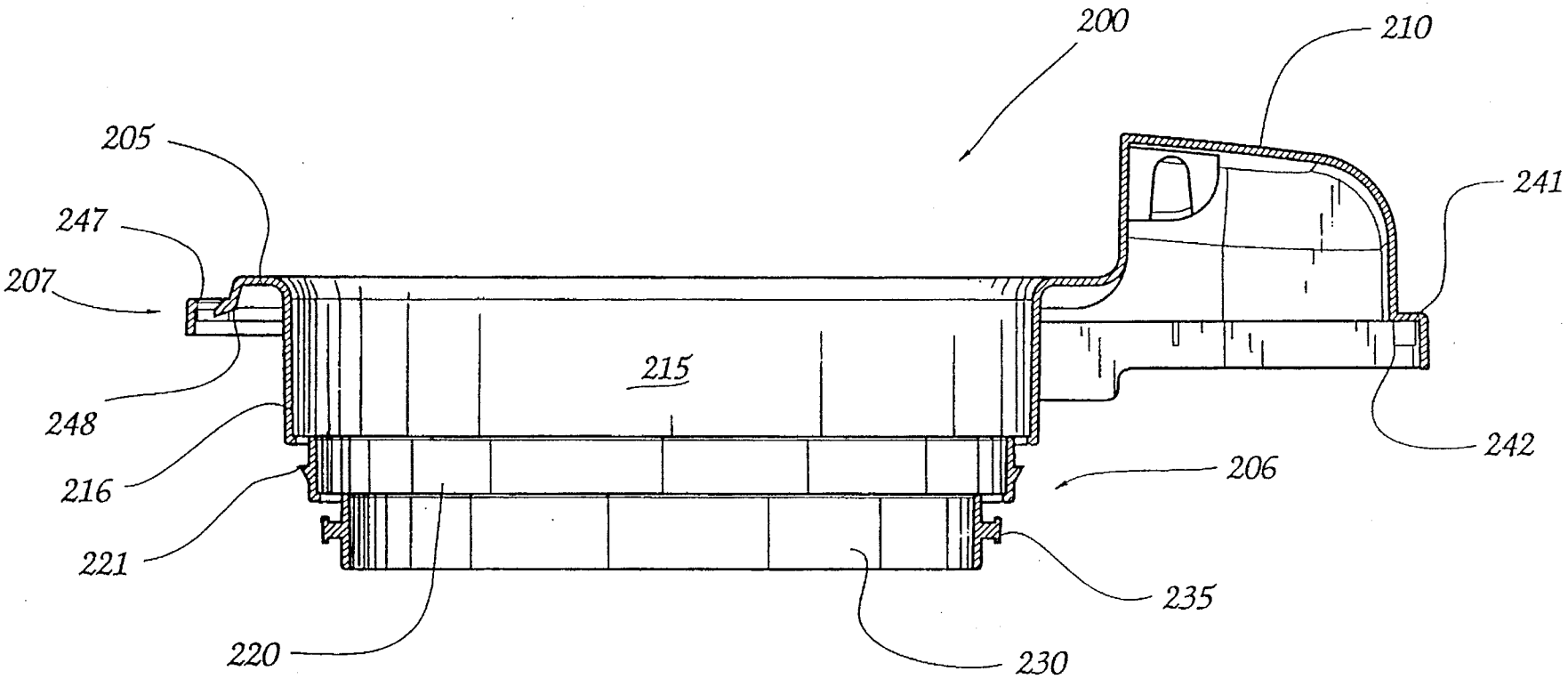
FIG. 4D is a cross-sectional view taken along line II—II in FIG. 4A.

Twist ring 250 is mounted to the under side of main cover 200 and rides above open end 122 of pail 110, with lower surface 261 of rim 260 disposed on the upper surface of beaded rim 123 of pail 110. Flange 270 extends into flange grooves 125 and 126. Twist ring 250 is supported under support lip 276 by beveled tabs 221 of twist ring support portion 220 of main cover 200. Referring to FIG. 1D, handle 265, twist ring 250 can be rotated by handle 265 between a closed position (indicated by letter A) and an open position (shown in phantom and indicated by letter B).

Figure 6A:
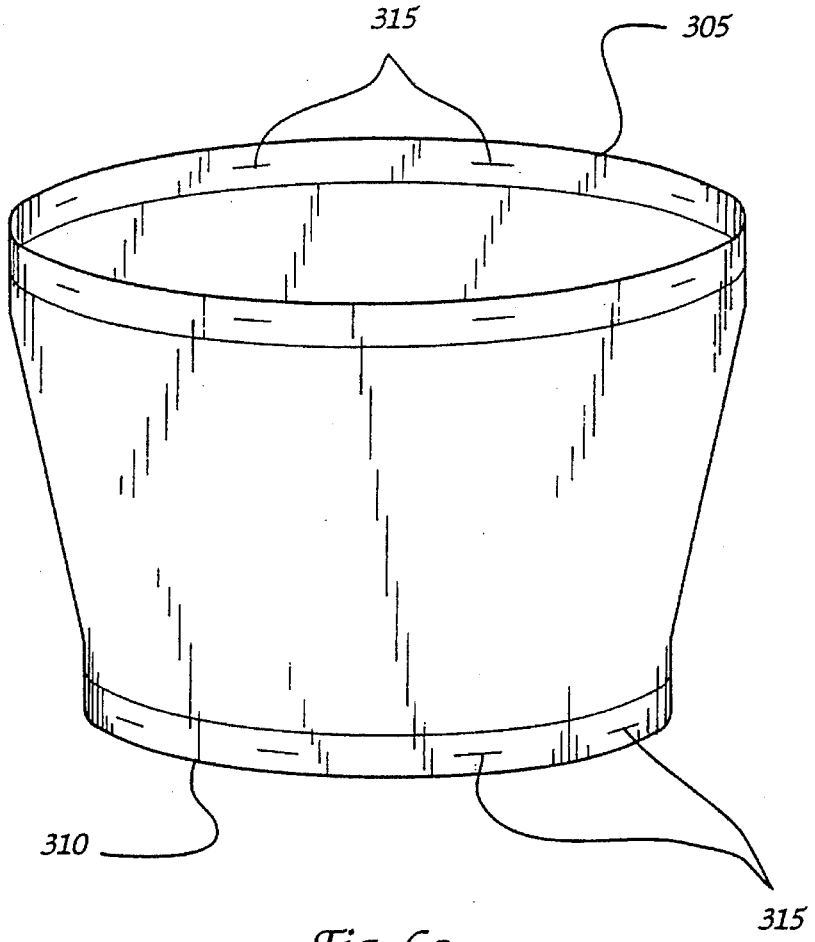
FIGS. 6A and B are side views of the flexible sleeve of the odorless container of FIG. 1 in the extended and folded states, respectively.
Figure 6B:
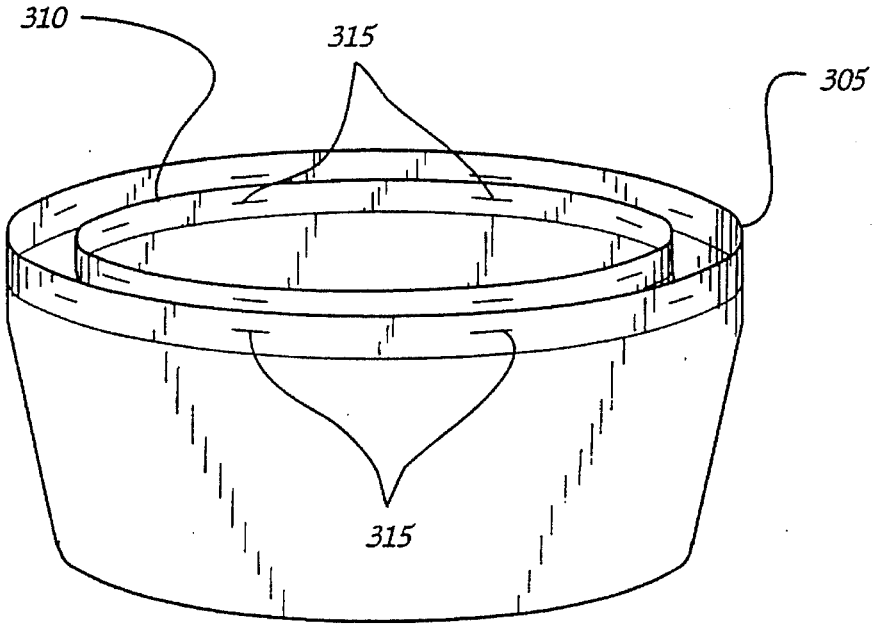

As shown in FIGS. 6A and B, flexible sleeve 300 has first and second open ends 305, 310, respectively and has a generally conical shaped body when unassembled. Both first and second ends 305 and 310 include mounting holes 315 that attach to posts 277, 235 of sleeve mounting rim 280 and inner sleeve support portion 230, respectively. In the present embodiment, flexible sleeve 300 is made from 70 denier nylon fabric, but any suitable material would suffice depending on the nature of the application (i.e., the tightness of the seal needed and the waste material to be stored). However, the material must be sufficiently flexible to allow the rotation of twist ring 250 so that flexible sleeve 300 pinches off the plastic bag. In addition, in the present embodiment the flexible sleeve is removable and washable.

Figure 7A:
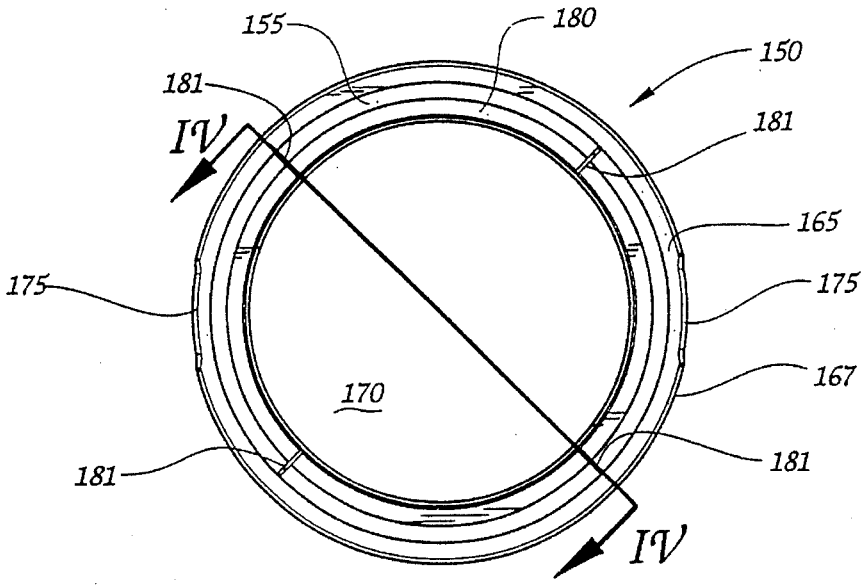
FIGS. 7A and B are bottom and side elevations of the bag retainer of the odorless container of FIG. 1
Figure 7B:
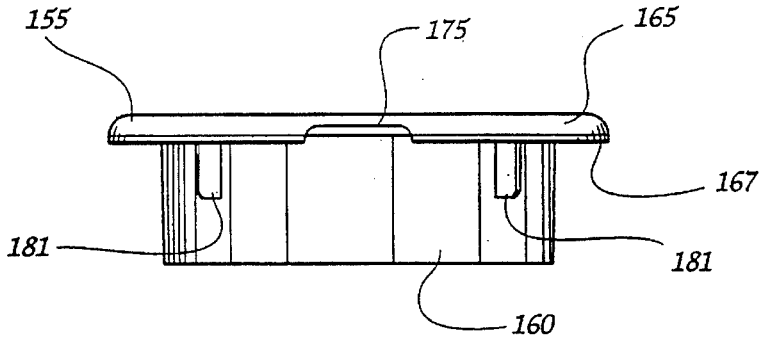
FIG. 7C is a cross-sectional view taken along line IV—IV.
Figure 7C:
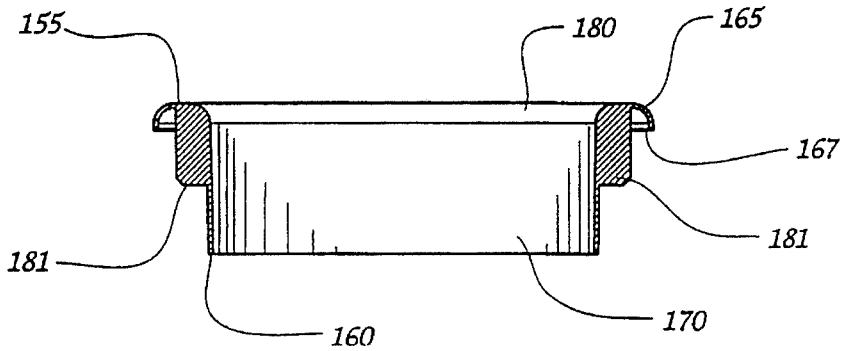
Figure 8A:
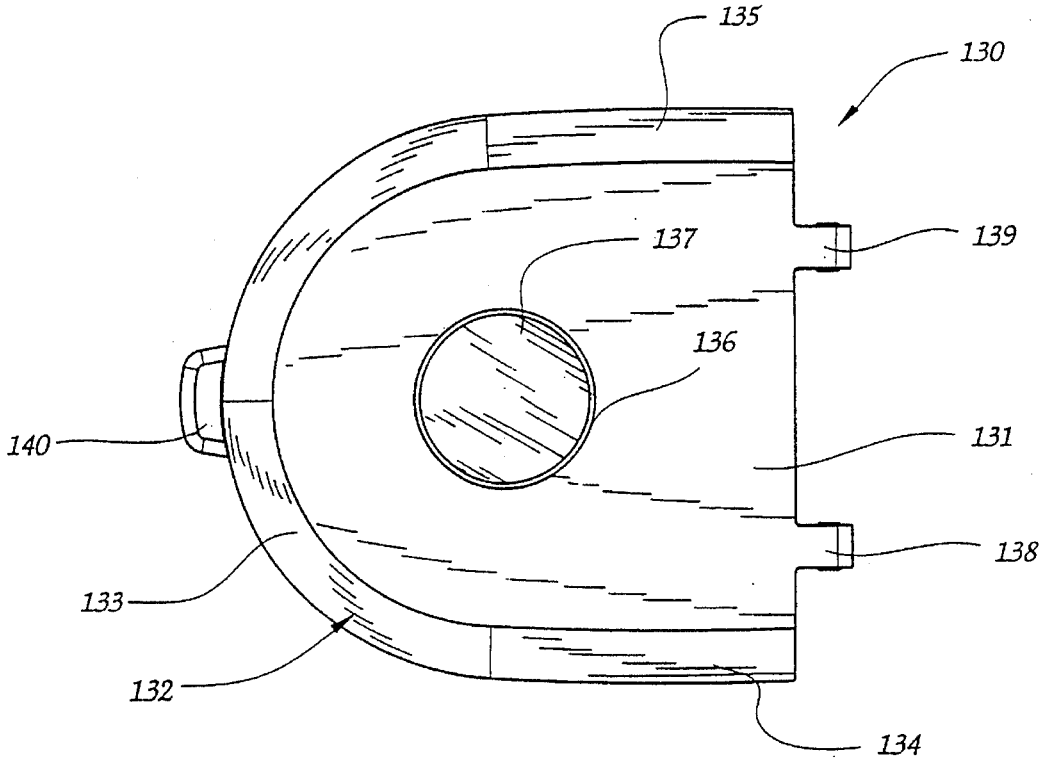
FIG. 8A–E are top, and bottom plan, and front, rear, and side elevation views, respectively of the lid assembly of the odorless container of FIG. 1.
Figure 8E:
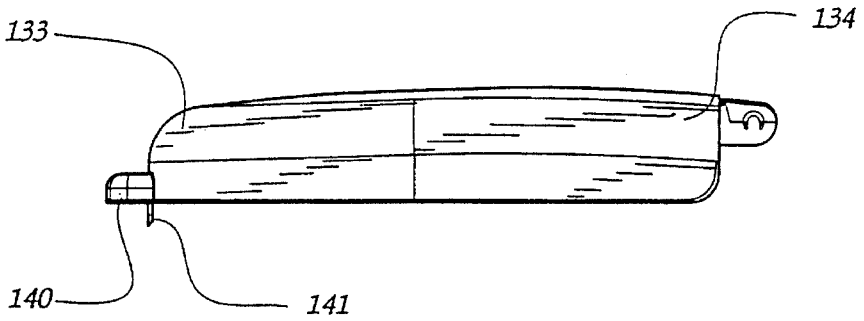
Figure 8C:
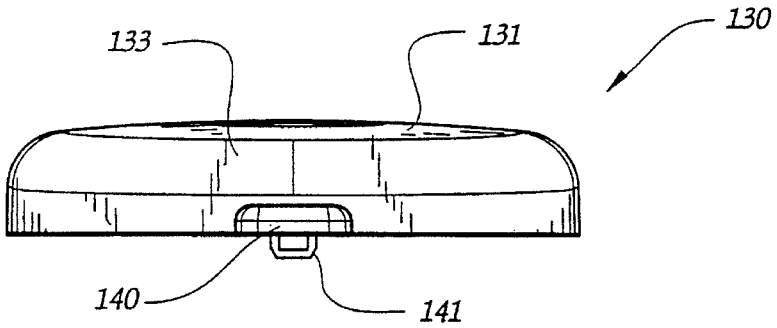
Figure 8D:
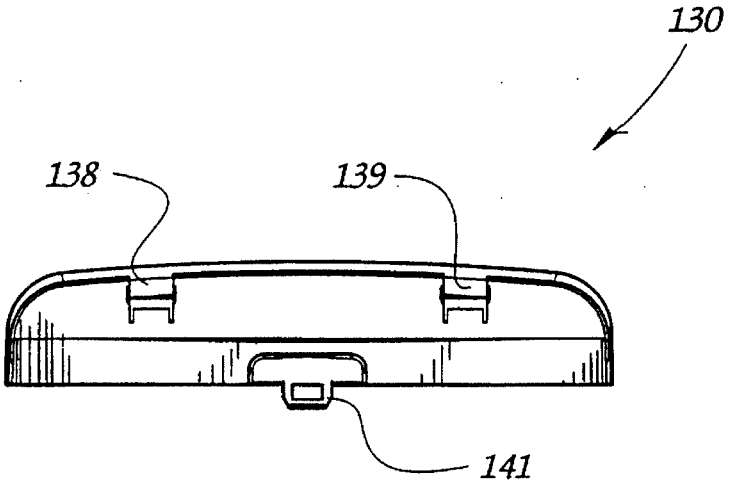
Figure 8B:
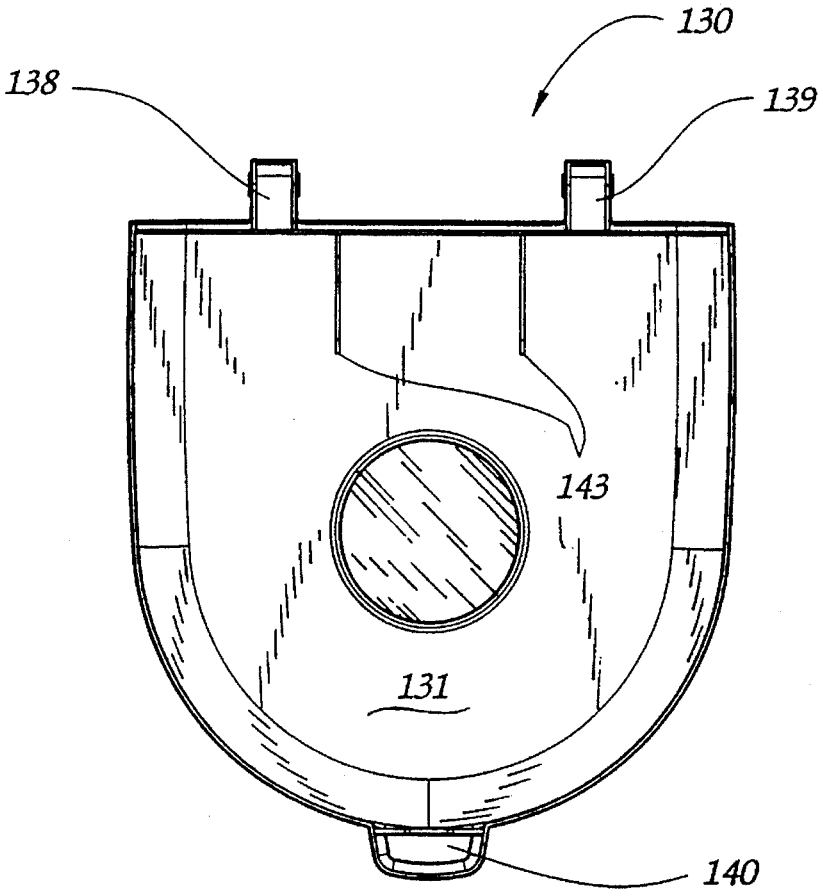

As shown in FIGS. 7A–C, bag retainer 150 has an annular body portion 155 having an inner shoulder 180, which has a waste tube 160 depending down therefrom, which forms a bag aperture 170, and a downwardly depending outer rim 165 extending around nearly the entire perimeter except for the two portions where handles 175 are formed to allow for easy removal. Outer rim 165 terminates in a lip 167 which, when assembled, rests on main cover 200 to hold bag retainer 150 in place. Four vertical webs 181 are formed between waste tube 160, shoulder 180 and body portion 155 and create a snug fit with upper portion 216 of main cover 200.

Lid assembly 130, which is shown in FIGS. 8A–E, includes a body portion 131 which has a downwardly depending rim 132 which includes a front side portion 133, a left side portion 134, and a right side portion 135 that seal against main cover 200. Front side portion 133 of body portion 131 includes a handle 140 and a flexible lid latch 141 which engages lid latch 246 of main cover 200 to hold lid assembly 130 in the closed position. Body portion 131 also includes an aperture 136 and left and right hinges 138, 139, respectively, which pivotally engage left and right hinge recesses 212, 213 of main cover 200 and allow lid assembly to pivot between an open and closed position. Odor absorber assembly 142, shown in FIG. 2, includes absorber 144 (such as shown in U.S. Pat. No. 5,174,462, the disclosure of which is incorporated herein by reference) and is mounted to the underside of lid assembly 130 between ribs 143. Window 137 is mounted in aperture 136 to allow the user to view the contents of container 100 when lid assembly is in the closed position.

Figure 9A:
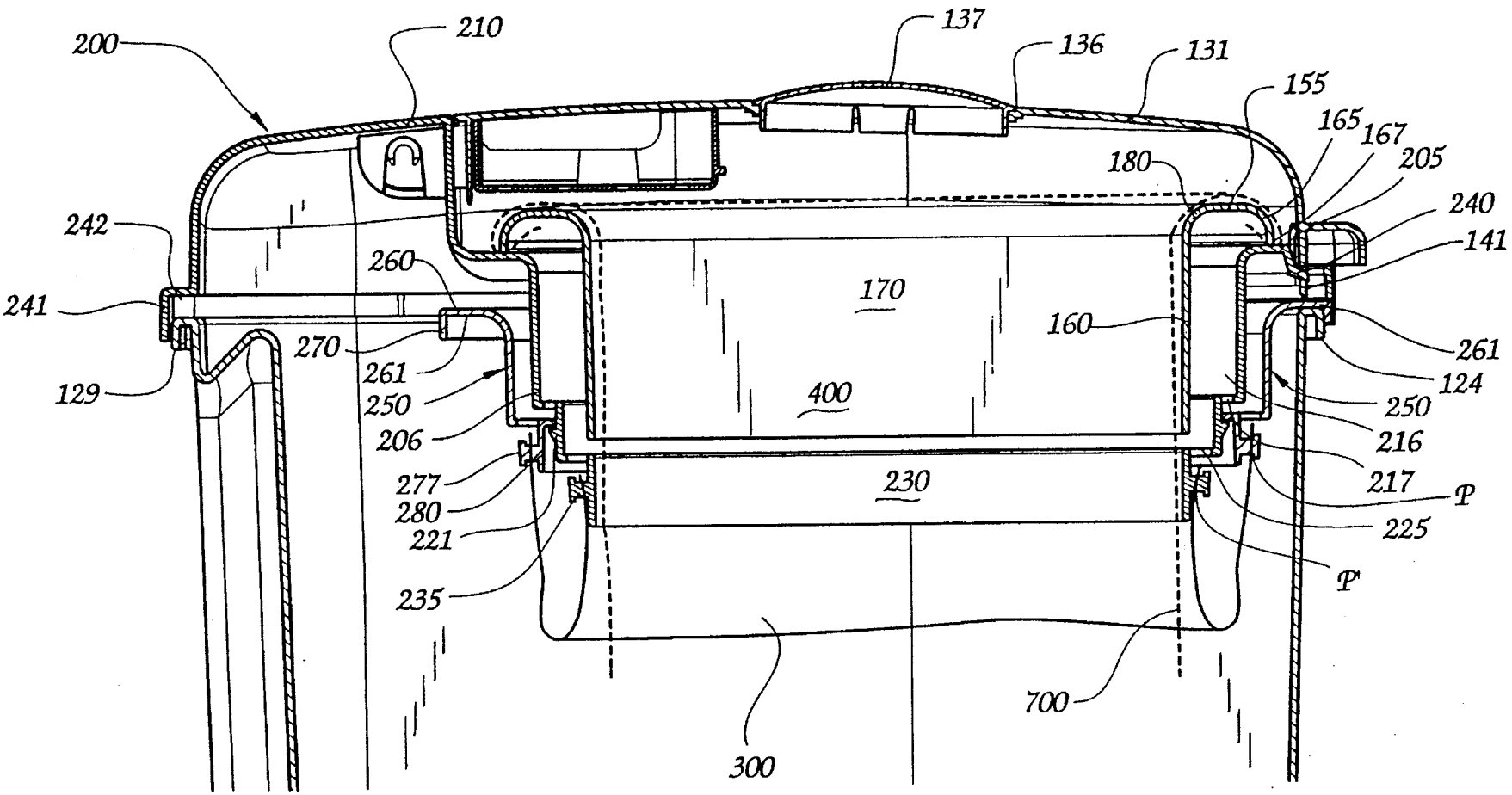
FIGS. 9A and B are partial cross-sectional views of the odorless container of FIG. 1C taken along line I—I with the flexible sleeve in the open and closed positions, respectively.
Figure 96:
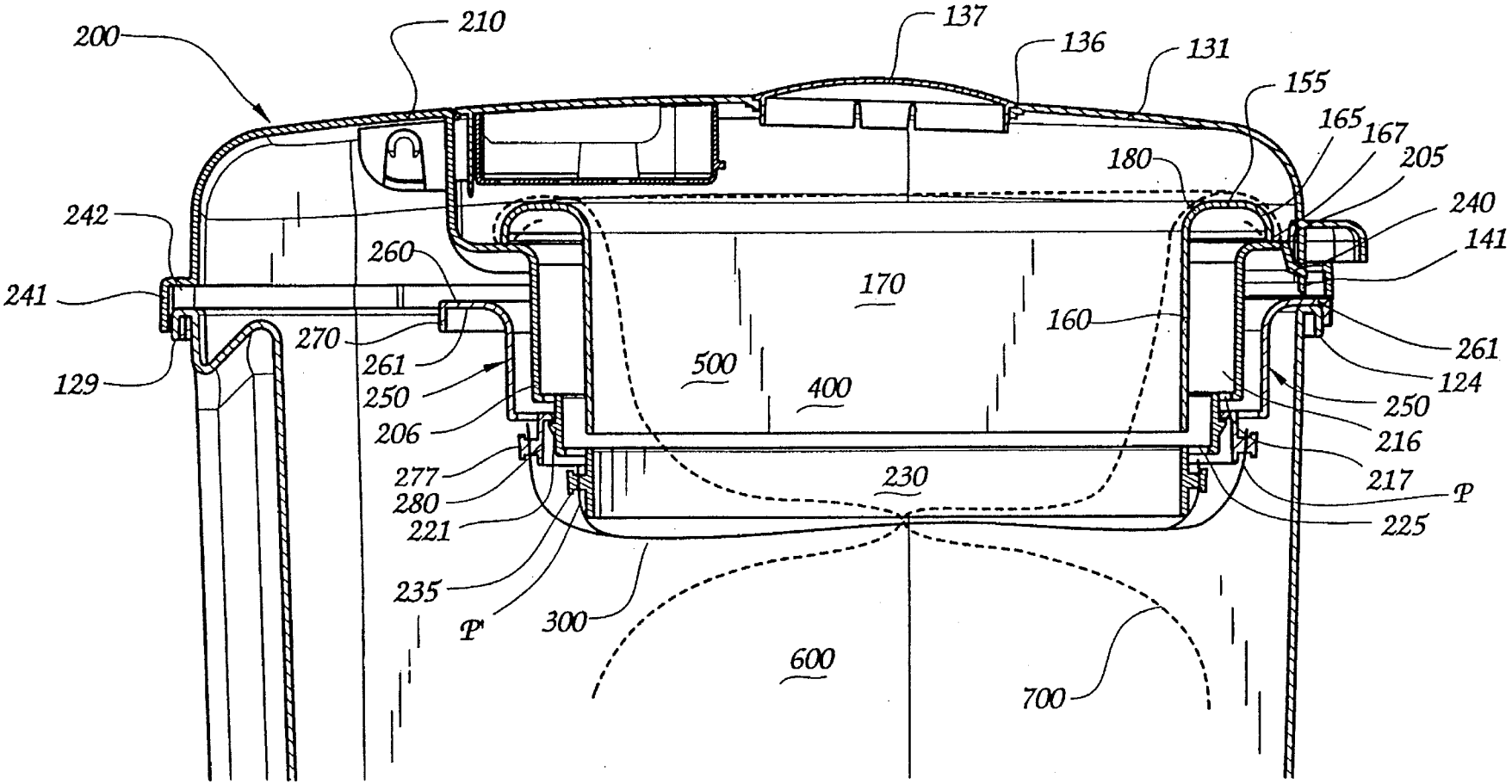

When assembled as shown in FIG. 9A, lid assembly 130, bag retainer 150, main cover 200, and twist ring 250, and flexible sleeve 300 form a cover assembly and are positioned so that the openings of bag retainer, main cover 200, and twist ring 250—bag aperture 170, waste passage 215, and waste aperture 290, respectively—define waste passage 400 which extends from body portion 155 of bag retainer 150 through sleeve support portion 230 of main cover 200. In addition, in this embodiment sleeve support portion 230 and sleeve retaining rim 280 are substantially (but not completely) coplanar, which provides vertical compactness, but also allows for easy removal of flexible sleeve 300 for washing (i.e., twist ring 250 may remain mounted to main cover 200 when removing and attaching flexible sleeve 300). However, the invention would also work well if sleeve support portion 230 and sleeve retaining rim 280 were not substantially coplanar, but vertically displaced from each other.

Operation

Before discussing the operation of odorless container 100, it is helpful to describe the workings of flexible sleeve 300. Referring to FIG. 9A which shows flexible sleeve 300 in the open position and bag 700 in phantom, every point (e.g., the point designated by the letter P) along the circumference of first end 305 of sleeve 300 (which is attached to twist ring 250) is adjacent its corresponding point (e.g., the point designated by the letter P') on the circumference of second end 310 (which is attached to main cover 200). Since the actual distance between these two points (P and P') is small, and the distance between these points on the sleeve is substantially greater (approximately equal to the length of the of sleeve 300), sleeve 300 hangs loosely, depending straight down from sleeve support portion 230 and sleeve retaining rim 280 and does not obstruct waste passage 400.

When the twist ring is rotated approximately 180° (by rotating handle 265) to the closed position as shown in FIG. 9B, every point (e.g., the point designated by the letter P) along the first end 305 of sleeve 300 is positioned directly opposite waste passage 400 from its corresponding point (e.g., the point designated by the letter P') on second end 310. Since the distance between these two points is substantially equal to the length of sleeve 300, sleeve 300 is pulled taught. Furthermore, since sleeve 300 is coupled to main cover 200 and twist ring 250, 360° around sleeve support portion 230 and sleeve retaining rim 280 respectively, sleeve 300 is pulled taught along the entire circumference of passage 400 resulting in a twisting action and therefore closes waste passage 400 with an action similar to that of a camera aperture. With the sleeve twisted closed, waste passage 400 and the remaining volume between lid assembly 130, main cover 200, and upper surface of closed sleeve 300 defines a holding chamber 500 that is fluidically isolated from storage chamber 600. Note that in this embodiment the bag does not twist shut. Instead the twisting of flexible sleeve 300 pinches bag 700 shut. Therefore after flexible sleeve 300 is opened, the weight of the waste material simply opens bag 700 (if it does not reopen by itself) as it falls from holding chamber 500 into storage chamber 600.

Although odorless container 100 will work without a liner, it is most effectively used with a liner such as an appropriately sized plastic bag. The closed end of bag 700 is inserted through waste passage 400 so that its closed end rests on bottom wall 120 of pail 110. As shown in FIG. 9A, the open end of bag 700, with the excess bag material (which is a result of the bag's diameter being greater than that of bag retainer 150), is then folded under outer rim 165 of bag retainer 150.

Before using odorless container 100, container 100 is put into the receiving state by rotating handle 265 of twist ring 250 to the closed position indicated by letter A of FIG. 1D, which closes flexible sleeve 300, pinches the bag shut, and isolates the two chambers as shown in FIG. 9B. Twist ring 250 will remain in its selected position (either open or closed) due to frictional forces between itself and both main cover 200 and front portion 124 of beaded rim 123 of pail 110.

To operate odorless container 100, the user opens lid assembly 130, deposits the waste material into holding chamber 500, and closes lid assembly 130. Next, the user rotates handle 265 from the closed position (indicated by letter A in FIG. 1D) to the open position (shown in phantom and indicated by letter B). The weight of the waste material will urge the bag and flexible sleeve 300 open so that the material will fall from holding chamber 500 into storage chamber 600. By observing the interior of odorless container 100 through window 137 of lid assembly 130, the user can determine when the waste material has fallen into storage chamber 600. The user will then rotate handle 265 from the open position to the closed position to put odorless container 100 back into the receiving state.

The user can also determine whether or not storage chamber 600 is full by observing the interior of odorless container 100 through window 137 when flexible sleeve 300 is opened. When storage chamber 600 is full (i.e., waste has piled up to a point slightly below the bottom of passage 400), the user simply closes flexible sleeve 300, opens lid assembly 130, removes the open end of bag 700 from bag retainer 150, and ties the open end of bag 700 shut with a conventional tying device such as a twist-tie. With bag 700 tied shut, the user opens flexible sleeve 300, removes the cover assembly from open end 122 of pail 110, and removes bag 700 from pail 110. The user then discards bag 700 in an appropriate fashion and installs a new bag in odorless container 100 as previously described.

Although the illustrated embodiment incorporates a bag retainer, the liner could be fixedly attached in any conventional manner to main cover 200, thus eliminating the need for a separate bag retainer. Although the length of flexible tube 300 in this embodiment is such that it will just barely reach across passage 400, the invention would work with a longer flexible sleeve by rotating the twist ring more than 180°. Furthermore, in other embodiments for use with other waste materials a more substantial and thicker liner may be required. Consequently, a somewhat shorter or longer flexible sleeve may more effectively pinch the liner closed depending on the thickness of the liner, the angular rotation of twist ring 250, and the elasticity of flexible sleeve 300.

In the previously described embodiment, twist ring 250 was held in place by frictional forces between twist ring 250, pail 110, and main cover 200. If an extremely tight seal is needed, a locking mechanism could be used to lock twist ring 250 in a closed position in which flexible sleeve 300 is pulled to an extremely tight closed position.

Although in the illustrated embodiment twist ring 250 rotates and main cover 200 is fixed, the invention would work equally well (with minor design changes apparent to the artisan) with a twist ring that is fixed and a rotatable main cover.

What is claimed is:

1. A receptacle, comprising:

a first, holding chamber;

a second, storage chamber in selective fluidic communication with said holding chamber;

a flexible sleeve disposed adjacent said chambers and moveable between a first open position in which said sleeve permits fluidic communication between said chambers, and a second, twisted position in which said sleeve is twisted closed to form a partition between said chambers to isolate said first chamber from said second chamber, said sleeve having, a first end, a second end, and a predetermined length;

said holding chamber has an open end distal from said second chamber;

a lid moveable between an open position and a closed position to selectively close said open end of said holding chamber;

a sleeve support portion coupled to said first end of said sleeve to hold said first end of said sleeve fixed with respect to said chambers;

a twist ring coupled to said second end of said sleeve and disposed for rotation to move said flexible sleeve between said first, open position, and said second, closed position, said twist ring having an actuator operable from outside said first chamber while said lid is closed; and said first end and said second end of said sleeve being vertically displaced from each other a distance substantially less than said length of said sleeve and in fixed vertical position with respect to each other.

2. The receptacle of claim 1, wherein said first and second ends of said sleeve are concentric.

3. The receptacle of claim 1, wherein said flexible sleeve is removable.

4. A receptacle, comprising:

a bag having an open end, a closed end, and an intermediate sidewall;

a pail having an open end and a closed end;

a first chamber disposed at said open end of said pail and receiving said open end of said bag;

a second chamber adjacent said first chamber and receiving said closed end of said bag;

a bag retaining member disposed at said open end of said pail to hold said open end of said bag in fixed position with respect to said pail; and a partition moveable between a first open position and a second, closed position in which said partition urges said sidewall of said bag together to close said bag and thereby isolate said chamber, said partition comprising a twist ring and a flexible sleeve, said sleeve being caused to twist shut by rotation of said twist ring and the twisting shut of said sleeve urging said sidewall of said bag together.

5. The receptacle of claim 4, further comprising:

said first chamber has an open end distal from said second chamber;

a lid moveable between an open position and a closed position to selectively close said open end of said first chamber;

said sleeve having a first fixed end and a second moveable end;

a sleeve support portion coupled to said first end of said sleeve to hold said sleeve fixed with respect to said chambers;

said twist ring having an actuator operable from outside said first chamber while said lid is closed to selectively move said sleeve between said first, open position and said second, closed position.

6. The receptacle of claim 4, wherein said first and second ends of said sleeve are concentric and said sleeve further includes a first end and a second end vertically displaced from each other a distance substantially less than the length of said sleeve.

7. The receptacle of claim 4, wherein said first and second ends of said sleeve are concentric and said sleeve further includes a first end and a second end vertically displaced from each other a distance substantially equal to the length of said sleeve.

8. The receptacle of claim 4, further comprising:

a cover mounted to said open end of said pail in fixed rotative position with respect to said pail; and wherein said bag retaining member is detachably mounted to said cover.

9. The receptacle of claim 8, further comprising a lid attached to said cover and moveable between an open and a closed position.

10. The receptacle of claim 9, wherein said bag retaining member is annular in shape.

11. A receptacle, comprising:

a pail having an open end and a cover mounted to said open end of said pail, said cover having a first ring, a second ring rotatably coupled to said pail;

a passage through said rings between said open end of said pail and said interior of said pail; and a partition coupled at a first end about the periphery of said first ring and at a second end to said second ring whereby rotating said second ring causes said partition to twist shut to close said passage, said partition comprising a twist ring and a flexible sleeve, said sleeve being caused to twist shut by rotation of said twist ring and the twisting shut of said sleeve urging said sidewall of said bag together.

12. The receptacle of claim 11, further comprising an actuator permitting rotation of said second ring from outside said container.

13. The receptacle of claim 11, further comprising:

a bag having an open end fixedly disposed substantially near said open end of said pail and a closed end disposed in said interior of said pail whereby said sleeve pinches said bag shut in said closed position.

14. The receptacle of claim 11, wherein:

said first ring is coupled to said cover; and said second ring is supported by said first ring and said open end of said pail.

15. The receptacle of claim 11, further comprising a lid moveable between an open position and a closed position to selectively close said open end of said pail.

16. The receptacle of claim 15, further comprising a deodorizer coupled to said lid.

17. The receptacle of claim 15, further comprising a window mounted in said lid.

18. The receptacle of claim 11, further comprising a foot recess mounted in said pail.

19. The receptacle of claim 11, further comprising a handle recess mounted in said pail.

20. The receptacle of claim 11, wherein:

said rings have posts;

said partition has mounting holes at said ends; and said posts extend through said mounting holes.

21. A receptacle, comprising:

a container having an open end and a closed end;

a lid coupled to said container and moveable between an open position and a closed position to selectively close said open end of said container;

a passage between said open end and said closed end of said container;

a partitioning member disposed in said container and moveable between an open and a closed position to selectively close said passage;

a first chamber bounded by said closed end of said container and said partitioning member in said closed position;

a second chamber bounded by said lid in said closed position and said partitioning member in said closed position;

a liner having an open end and a closed end, said liner being disposed in said passage with said closed end of said liner being disposed in said first chamber, said open end of said liner being disposed in said second chamber and in fixed position with respect to said container;

said open end and said closed end of said liner being in fluidic communication when said partitioning member is in said open position; and said partitioning member preventing fluidic communication between said open end and said closed end of said liner when said partitioning member is in said closed position, said partitioning member comprising a twist ring and a flexible sleeve, said sleeve being caused to twist shut by rotation of said twist ring and the twisting shut of said sleeve urging said sidewall of said bag together.

22. The receptacle of claim 21, further comprising a bag retaining member disposed in said second chamber for holding said open end of said liner in place.

23. The receptacle of claim 22, wherein:

said container includes a pail and a cover attached to said pail in fixed rotative position with respect to said pail;

said lid is attached to said cover; and said bag retaining member is detachably coupled to said cover.

24. The receptacle of claim 23, wherein:

said bag retaining member is annular.

25. A receptacle, comprising:

a container having an interior and an open end;

a first ring coupled to said container;

a second ring rotatably coupled to said container and disposed concentrically with said first ring;

a passage through said rings between said open end and said interior of said container; and a partition coupled at a first end about the periphery of said first ring and at a second end to said second ring whereby rotating said second ring causes said partition to twist shut to close said passage;

a bag having an open end fixedly disposed substantially near said open end of said container and a closed end disposed in said interior of said container whereby said partition pinches said bag shut in said closed position; and a bag retainer mounted to said first ring.

26. The receptacle of claim 25, wherein said partition is a flexible sleeve.

27. The receptacle of claim 26, further comprising a lid moveable between an open position to selectively close said open end of said container.

28. The receptacle of claim 27, further comprising a deodorizer coupled to said lid.

29. The receptacle of claim 27, further comprising a window mounted in said lid.

30. The receptacle of claim 26, further comprising a foot recess mounted in said container.

31. The receptacle of claim 26, further comprising a handle recess mounted in said pail.

32. The receptacle of claim 25, wherein:

said rings have posts;

said partition has mounting holes at said first and second ends; and said posts extend through said mounting holes.

33. A method of disposing of waste in a receptacle that prevents the escape of offensive odors, the receptacle having a container with an open end, a closed end, a partitioning member separating a first chamber and a second chamber, a lid, and a liner having an open end and a closed end, said partitioning member comprising a twist ring and a flexible sleeve, said sleeve being caused to twist shut by rotation of said twist ring and the twisting shut of said sleeve urging said sidewall of said bag together, comprising the steps of:

opening the lid;

inserting the closed end of the liner into the closed end of the container;

fixing the open end of the liner in fixed position with respect to the container;

twisting the flexible sleeve shut by rotating the twist ring, depositing the waste into the first chamber;

closing the lid; and twisting the flexible sleeve open by rotating the twist ring to allow the waste to move from the first chamber into the second chamber.

* * * * *